US009496596B2

(12) United States Patent
Chirila

(10) Patent No.: US 9,496,596 B2
(45) Date of Patent: Nov. 15, 2016

(54) DIELECTRIC STRUCTURE FOR ANTENNAS IN RF APPLICATIONS

(75) Inventor: Laurian Petru Chirila, Irvine, CA (US)

(73) Assignee: Symbol Technologies, LLC, Holtsville, NY (US)

( * ) Notice: Subject to any disclaimer, the term of this patent is extended or adjusted under 35 U.S.C. 154(b) by 821 days.

(21) Appl. No.: 13/520,739

(22) PCT Filed: Jan. 6, 2011

(86) PCT No.: PCT/US2011/020369

§ 371 (c)(1),
(2), (4) Date: Jul. 5, 2012

(87) PCT Pub. No.: WO2011/085097

PCT Pub. Date: Jul. 14, 2011

(65) Prior Publication Data

US 2012/0276311 A1 Nov. 1, 2012

Related U.S. Application Data

(63) Continuation-in-part of application No. 12/683,294, filed on Jan. 6, 2010, now abandoned.

(51) Int. Cl.
*H01Q 1/22* (2006.01)
*H01Q 1/38* (2006.01)
(Continued)

(52) U.S. Cl.
CPC ..... *H01Q 1/2208* (2013.01); *H01Q 1/38* (2013.01); *H01Q 1/526* (2013.01); *H01Q 5/364* (2015.01); *H01Q 9/0407* (2013.01); *Y10T 428/13* (2015.01); *Y10T 428/2495* (2015.01); *Y10T 428/249923* (2015.04); *Y10T 428/31544* (2015.04)

(58) Field of Classification Search
CPC ..... B32B 3/00; B32B 3/10; B32B 3/18; B32B 3/26; B32B 3/28; B32B 27/08; B32B 27/322; C09D 127/12; H01Q 1/2208; H01Q 1/243; H01Q 21/065; H01Q 1/38; H01Q 9/04; H01Q 9/0407; H01Q 1/40; H01Q 1/526; H01Q 5/364
USPC ..... 428/166, 323, 325, 421; 343/700 MS, 343/846
See application file for complete search history.

(56) References Cited

U.S. PATENT DOCUMENTS 4,170,013 A * 10/1979 Black ..... 343/700 MS
4,682,180 A 7/1987 Gans
(Continued)

FOREIGN PATENT DOCUMENTS

GB 2447244 A 9/2008
JP H09-64636 A 3/1997
JP 2002344146 A 11/2002

OTHER PUBLICATIONS

International Preliminary Report on Patentability from the International Bureau for corresponding International Application No. PCT/US2011/020369 issued Jul. 10, 2012.
(Continued)

*Primary Examiner* — Catherine A Simone

(57) ABSTRACT

A dielectric structure for positioning adjacent to an active element of an antenna for radio frequency (RF) applications, the dielectric structure comprising: a plurality of individual dielectric material layers in a stacked layer arrangement including a first layer including a first dielectric material and a second layer including a second dielectric material.

25 Claims, 24 Drawing Sheets

(51) Int. Cl.

| | |
|---|---|
| ***H01Q 5/364*** | (2015.01) |
| ***H01Q 1/52*** | (2006.01) |
| ***H01Q 9/04*** | (2006.01) |

(56) References Cited

U.S. PATENT DOCUMENTS

| | | | | |
|---|---|---|---|---|
| 5,121,127 | A | 6/1992 | Toriyama | |
| 5,155,493 | A * | 10/1992 | Thursby et al. | 343/700 MS |
| 5,296,651 | A | 3/1994 | Gurrie et al. | |
| 5,448,219 | A | 9/1995 | Yoshikawa et al. | |
| 5,757,327 | A | 5/1998 | Yajima et al. | |
| 5,926,136 | A | 7/1999 | Ohtsuka et al. | |
| 5,970,393 | A | 10/1999 | Khorrami et al. | |
| 5,977,915 | A | 11/1999 | Bergstedt et al. | |
| 5,982,335 | A | 11/1999 | Faraone et al. | |
| 6,215,454 | B1 | 4/2001 | Tran | |
| 6,266,016 | B1 | 7/2001 | Bergstedt et al. | |
| 6,396,442 | B1 | 5/2002 | Kawahata et al. | |
| 7,315,248 | B2 | 1/2008 | Egbert | |
| 7,477,197 | B2 | 1/2009 | Zeng et al. | |
| 7,518,553 | B2 | 4/2009 | Zhang et al. | |
| 7,619,571 | B2 | 11/2009 | Vesterinen | |
| 7,982,684 | B2 | 7/2011 | O'Connell et al. | |
| 8,497,804 | B2 * | 7/2013 | Haubrich | A61N 1/37229 343/700 MS |
| 2002/0024465 | A1 | 2/2002 | Kawahata et al. | |
| 2003/0052825 | A1 | 3/2003 | Rao et al. | |
| 2003/0103006 | A1 * | 6/2003 | Yamada | H01L 23/66 343/700 MS |
| 2004/0056803 | A1 | 3/2004 | Soutiaguine et al. | |
| 2004/0080465 | A1 | 4/2004 | Hendler et al. | |
| 2005/0245001 | A1 | 11/2005 | Hyvonen et al. | |
| 2006/0092079 | A1 | 5/2006 | de Rochemont | |
| 2006/0255945 | A1 | 11/2006 | Egbert | |
| 2006/0281864 | A1 * | 12/2006 | Nelson | 525/199 |
| 2007/0052588 | A1 | 3/2007 | Liu et al. | |
| 2008/0055164 | A1 | 3/2008 | Zhang et al. | |
| 2008/0297419 | A1 | 12/2008 | Dou et al. | |
| 2009/0207080 | A1 | 8/2009 | Floyd et al. | |
| 2009/0207092 | A1 | 8/2009 | Nysen et al. | |
| 2009/0289854 | A1 | 11/2009 | Berezin et al. | |
| 2012/0280877 | A1 | 11/2012 | Chirila | |

OTHER PUBLICATIONS

International Preliminary Report on Patentability from the International Bureau for International Application No. PCT/US2011/020381 issued Jul. 10, 2012, which international application corresponds to copending U.S. Appl. No. 13/520,737, filed Jul. 5, 2012 by Laurian Petru Chirila.

International Search Report and Written Opinion for counterpart International Patent Application No. PCT/US2011/020381 mailed Mar. 23, 2011.

Non Final Office Action mailed May 7, 2012 in counterpart U.S. Appl. No. 12/683,294, Laurian Petru Chirila, filed Jan. 6, 2010.

International Search Report and Written Opinion of the International Searching Authority in corresponding International Application PCT/US2011/020369 mailed Jun. 30, 2011.

Supplementary European Search Report for counterpart European patent application No. 11 732 142 mailed Nov. 30, 2015.

Supplementary European Search Report for counterpart European patent application No. 11 732 147 mailed Dec. 1, 2015.

Canadian Office Action for counterpart Canadian patent application No. 2,783,628 mailed Mar. 8, 2016.

Canadian Office Action for counterpart Canadian patent application No. 2,783,629 mailed Mar. 9, 2016.

Non Final Office Action mailed Feb. 21, 2014 in counterpart U.S. Appl. No. 13/520,737, Laurian Petru Chirila, filed Jul. 5, 2012.

Final Office Action mailed Jun. 16, 2014 in counterpart U.S. Appl. No. 13/520,737, Laurian Petru Chirila, filed Jul. 5, 2012.

Non Final Office Action mailed Sep. 20, 2014 in counterpart U.S. Appl. No. 13/520,737, Laurian Petru Chirila, filed Jul. 5, 2012.

Kamogawa K, et al. "A Novel Microstrip Antenna Using Alumina-Ceramic/Polyimide Multilayer Dielectric Substrate", IEEE MTT-S International Microwave Symposium Digest, 1996, pp. 71-74, vol. 1, San Francisco, USA.

Kuwahara Y, et al. "Phased Array Antenna with a Multilayer Substrate," IEE Proceedings: Microwaves, Antennas, and Propagation, 1994, pp. 295-298, GB.

Final Office Action mailed Dec. 12, 2014 in counterpart U.S. Appl. No. 13/520,737, Laurian Petru Chirila, filed Jul. 5, 2012.

Non Final Office Action mailed Mar. 18, 2015 in counterpart U.S. Appl. No. 13/520,737, Laurian Petru Chirila, filed Jul. 5, 2012.

Final Office Action mailed Jun. 29, 2015 in counterpart U.S. Appl. No. 13/520,737, Laurian Petru Chirila, filed Jul. 5, 2012.

Non final Office Action mailed Nov. 3, 2015 in counterpart U.S. Appl. No. 13/520,737, Laurian Petru Chirila, filed Jul. 5, 2012.

* cited by examiner

DIELECTRIC STRUCTURE FOR ANTENNAS IN RF APPLICATIONS

CROSS-REFERENCE TO RELATED APPLICATIONS

This application is a 35 U.S.C. §371 national stage application claiming the priority benefits of International Patent Application No. PCT/US2011/020369, filed Jan. 6, 2011, which claims the benefit of U.S. application Ser. No. 12/683,294 filed Jan. 6, 2010, which are all hereby incorporated herein by reference in their entireties.

The present invention relates to dielectric structures for antennas configured for radio frequency applications.

BACKGROUND

Radio Frequency (RF) antennas are becoming more prevalent in a wide variety of portable computing devices, such as cell phones, personal data assistants (PDAs), and handheld devices such as Radio Frequency Identification (RFID) readers. In Ultra High Frequency (UHF) applications, RFID is becoming more and more popular in the field of contactless identification, tracking, and inventory management. UHF RFID is currently replacing the more traditional portable barcode readers, since use of barcode labels have a significant number of disadvantages such as: limited quantity of information storage of the product associated with the barcode; increased amounts of stored data by the barcode is becoming more complicated due to the limited number of lines and/or patterns that can be printed in a given space; increased complexity of the lines and/or patterns can make the barcode label hard and slow to read and very sensitive to the distance between the label and reader; and direct line-of-sight limitations as the barcode reader must "see" the label.

However, there are significant disadvantages with the current state of the art for miniaturization of antennas, in view of the ever increasing desire for smaller and more complex portable computing devices. It is recognised that as the size of the portable computing device is decreased, the amount of available space in the housing of the portable computing device becomes a premium. Also, as more and more device features are included in today's portable computing devices, there is less room available in the housing to position all of the desired device features.

However, miniaturization of antennas can come at a cost of decreased antenna performance, e.g. antenna gain and general antenna efficiency. It is recognised that by using high dielectric constant materials between the antenna conductors, the antenna footprint can be reduced but at an expense of antenna thickness, i.e. an increased thickness of dielectric materials between the antenna conductors can be a result of decreased antenna footprint. However, excessive thicknesses of dielectric materials can result in an undesirable decrease in the dielectric constant exhibited by the dielectric material, which results in an overall undesirable decrease in the gain of the antenna.

Further, higher dielectric materials are typically more expensive than lower dielectric materials, so the added cost of material used in the manufacture of miniaturized antennas can become an issue.

SUMMARY

There is an object of the present invention to provide an improved dielectric structure for an antenna that overcomes or otherwise mitigates at least one of the above discussed disadvantages.

In view of known dielectric materials using in antenna manufacture, it is known that excessive thicknesses of dielectric materials can result in an undesirable decrease in the dielectric constant exhibited by the dielectric material, which results in an overall undesirable decrease in the gain of the antenna. Further, higher dielectric materials are typically more expensive than lower dielectric materials, so the added cost of material used in the manufacture of miniaturized antennas can become an issue. Contrary to prior art systems, provided is a dielectric structure for positioning adjacent to an active element of an antenna for radio frequency (RF) applications, the dielectric structure comprising: a plurality of individual dielectric material layers in a stacked layer arrangement including a first layer including a first dielectric material and a second layer including a second dielectric material.

A first aspect provided is dielectric structure for positioning adjacent to an active element of an antenna for radio frequency (RF) applications, the dielectric structure comprising: a plurality of individual dielectric material layers in a stacked layer arrangement including a first layer including a first dielectric material and a second layer including a second dielectric material.

A second aspect provided is a dielectric structure for positioning adjacent to an active element of an antenna for radio frequency (RF) applications, the dielectric structure comprising: a plurality of individual dielectric material layers in a stacked layer arrangement including a first layer including a first dielectric material and a second layer including a second dielectric material, such that the plurality of individual dielectric material layers provides for a higher overall dielectric constant for dielectric structure as compared to a single dielectric element of similar thickness to that of the combined thickness of the plurality of individual dielectric material layers.

BRIEF DESCRIPTION OF THE DRAWINGS

These and other features of the invention will become more apparent in the following detailed description in which reference is made to the appended drawings by way of example only, wherein.

DESCRIPTION

Figure 1:
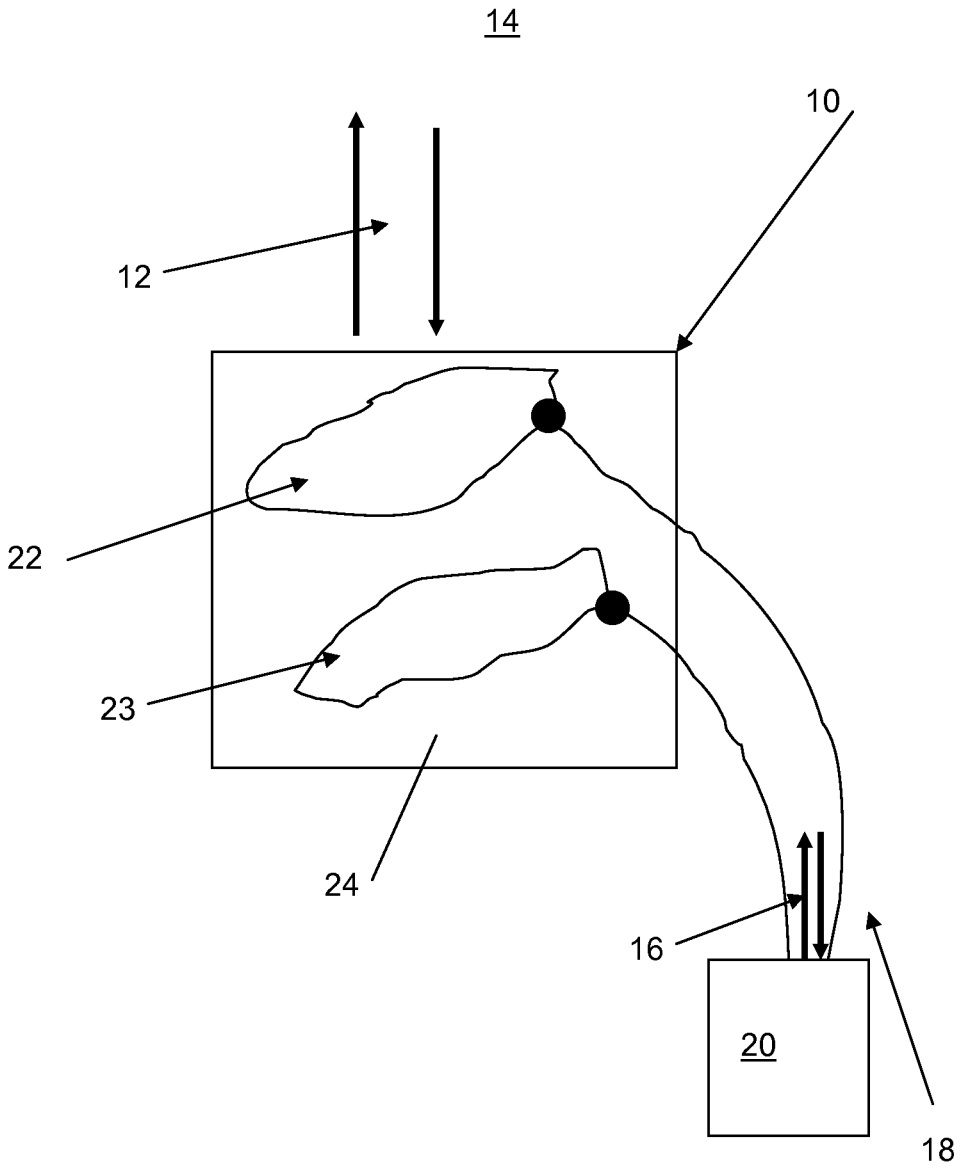
FIG. 1 is a schematic diagram of an antenna in accordance with the present invention.

In FIG. 1 an antenna in accordance with the present invention is indicated generally at 10. In the attached Figures, like components in different Figures are indicated with like reference numerals.

Antenna 10 operates as a transducer to transmit and/or receive radio frequency (RF) electromagnetic radiation 12 from a surrounding environment 14. Antenna 10 includes a layered dielectric structure 24 composed of two or more dielectric materials, hereafter referred to as RF dielectric materials described in greater detail below, which functions as a suitable dielectric resonator for the operational RF frequency (or frequencies) of the antenna 10. As is well known, antennas such as antenna 10 convert RF electromagnetic radiation 12 into alternating electrical currents 16 (e.g. receive operation) and convert alternating electrical currents 16 into RF electromagnetic radiation 12 (e.g. transmit operation). The alternating electrical currents 16 are communicated via a feed line 18 coupled between the antenna 10 and a current source or sink, depending upon the transmit or receive operation respectively. The current source or sink can be any suitable radio device 20 including by example, without limitation, a radio transmitter, a receiver or a transceiver constructed as an integrated circuit, an integrated module or a circuit constructed from discrete components.

The feed line 18 can be any suitable means for connecting the antenna 10 to the radio device 20 including by example, without limitation, a coaxial or other shielded cable, a pair of traces on a circuit board, a pair of insulated and spaced conductors or any other suitable means for conveying a RF electrical signal (as the alternating electrical currents 16) between the antenna 10 and the radio device 20.

The antenna 10 can be used in a wide variety of communication systems such as radio and television broadcasting, point-to-point radio communication, wireless LAN, radar, product tracking and/or monitoring via Radio-Frequency Identification (RFID) applications and space exploration, based on configuration of the layered dielectric structure 24 as further described below. Example operational frequencies (of the RF electromagnetic radiation 12) for the antenna 10 can be suitable for RF applications in the Ultra High Frequency (UHF) range of 300 MHz to 3 GHz (3,000 MHz) and higher (e.g. 3 GHz to 14 GHz), for example dual/multi-band 3G/4G applications for multiple frequency bands such as but not limited to 700/850/900 MHz and 1800/1900/2100 MHz within two major low and high wavelength super bands. However, it is recognised that the antenna 10 is not so limited in operational frequency. In fact, antenna 10 configured with the layered dielectric structure 24 can be operated for a RF application in one or more RF frequency ranges other than in the UHF band, including even higher RF frequencies as noted above.

Referring again to FIG. 1, the dielectric loading of the antenna 10, as supplied by the RF dielectric materials in the layers 25 of the layered dielectric structure 24, affects both its radiation pattern and impedance bandwidth. As the dielectric constant $D_k$ of the layered dielectric structure 24 increases, the antenna 10 bandwidth decreases, which increases the Q factor of the antenna 10 and therefore decreases the impedance bandwidth. In general, the radiation energy generated from or received by the antenna can have the highest directivity when the antenna has an air dielectric (i.e. a RF unsuitable material) and decreases as the antenna is loaded by the dielectric material with increasing relative dielectric constant $D_k$. The impedance bandwidth of the antenna 10 is strongly influenced by the spacing (thickness T) between the active element 22 and the ground element 23. As the active element 22 is moved closer to the ground element 23, thereby decreasing thickness T, less energy is radiated and more energy is stored in the capacitance and inductance of the antenna 10.

A good RF dielectric material for the layers 25 contains polar molecules that reorient in an external electric field, such that this dielectric polarization suitably increases the antenna's capacitance for RF applications of the antenna 10.

Generalizing this, any insulating substance could be called a dielectric material, however while the term "insulator" refers to a low degree of electrical conduction, the term "RF dielectric" is used to describe materials with a measured high polarization density that is suitable for use in the design and operation of the antenna 10 for RF applications. It is recognised that RF dielectric materials resonate during the generating and/or receiving of the RF electromagnetic radiation 12 for RF applications of the antenna 10, while exhibiting lower dielectric losses (as compared to RF unsuitable material) at the RF frequencies of the antenna 10. In general, the dielectric constant $D_k$ of a material under given conditions is a measure of the extent to which it concentrates electrostatic lines of flux. The dielectric constant $D_k$ is the ratio of the amount of stored electrical energy when a potential is applied, relative to the permittivity of a vacuum. The dielectric constant $D_k$ is the same as the dielectric constant $D_k$ evaluated for a frequency of zero. Other terms used for the dielectric constant $D_k$ can be relative static permittivity, relative dielectric constant, static dielectric constant, frequency-dependent relative permittivity, or frequency-dependent relative dielectric constant, depending upon context. When the dielectric constant $D_k$ is defined as the relative static permittivity $\in_r$, this can be measured for static electric fields as follows: first the capacitance of a test capacitor, $C_0$, is measured with vacuum between its plates; then, using the same capacitor and distance between its plates the capacitance $C_x$ with a dielectric between the plates is measured; and then the relative static permittivity $\in_r$ can be then calculated as $\in_r = C_x/C_0$. For time-variant electromagnetic fields, this quantity can be frequency dependent and in general is called relative permittivity.

A dielectric resonator property for the antenna 10 can be defined as an electronic component that exhibits resonance for a selected narrow range of RF frequencies considered the operational RF frequencies of the antenna 10, in the microwave band for example. The resonance of the layered dielectric structure 24 can be similar to that of a circular hollow metallic waveguide, except that the boundary is defined by large change in permittivity rather than by a conductor. The dielectric resonator property of the layered dielectric structure 24 is provided by a specified thickness T of the selected RF dielectric material(s), in this case as the plurality of individual physical layers 25, such that each of the layers 25 has a selected large dielectric constant $D_k$ and considered minimal dielectric losses in the RF dielectric material represented by a low dissipation factor $D_f$, which is important for RF dielectric materials used in the manufacture of antennas suitable for RF applications. The dissipation factor, $D_f$, of dielectric materials is a measure of the dielectric losses inside the material, as a result of conversion into heat energy of a portion of the RF electromagnetic radiation 12 experienced by the material.

The resultant RF suitability of the layered dielectric structure 24 can be determined by the overall physical dimensions of the layered dielectric structure 24 and the dielectric constant(s) $D_k$ of the RF dielectric material(s) used in the layers 25.

Figure 2:
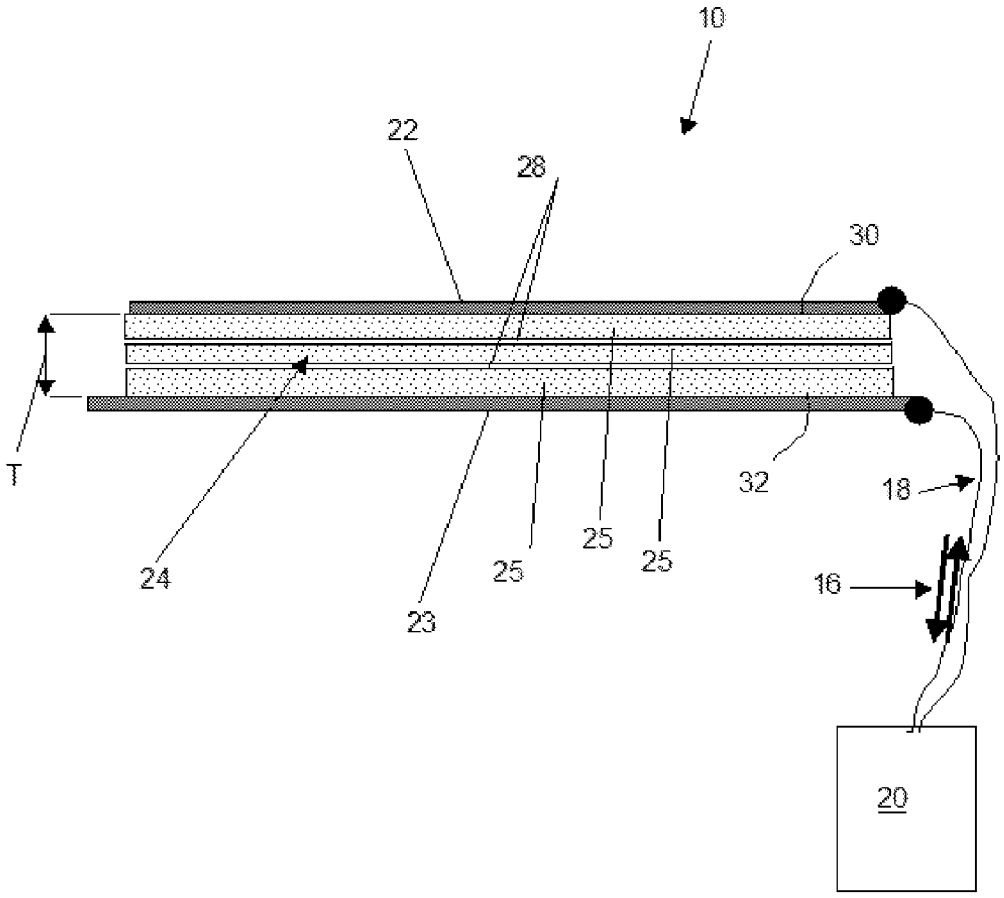
FIG. 2 is a side view of a first embodiment of the antenna of FIG. 1 including a layered dielectric structure dielectric structure.

Referring now to FIGS. 1 and 2, the antenna 10 can comprise an active element 22 isolated from a ground element 23 by the layered dielectric structure 24, which is positioned between the active element 22 and the ground element 23 and the feed line 18 is used to connect the active element 22 and the ground element 23 to the radio device 20.

The layered dielectric structure 24 functions as a dielectric resonator for the antenna 10 in the operational RF frequency (or frequencies) of the antenna 10 and comprises at least two layers 25 of RF dielectric material assembled in a stacked-layer arrangement. The dielectric material of each of layers 25 is RF dielectric material providing a measured high polarization density (indicated by the rated dielectric constant $D_k$ of the RF dielectric material) that is suitable for use in the design and operation of the antenna 10 for RF applications (i.e. the RF dielectric material has the ability to resonate during transmission and/or reception of RF electromagnetic radiation 12 at the operational RF frequency or frequencies of the antenna 10, while at the same time having an RF suitable dissipation factor $D_f$, for example less than 0.01). The layers 25 comprising layered dielectric structure 24 can be formed of the same RF dielectric material, or different RF dielectric materials, as in discussed more fully below. For example, the dielectric structure 24 can include a first layer 25 having a first RF dielectric material and a second layer 25 having a second RF dielectric material. It is recognised that the first RF dielectric material and the second RF dielectric material in the layers 25 can be the same or different RF dielectric material. In the case where the RF dielectric materials are different, preferably the dielectric constant of the different RF dielectric materials are substantially the same or similar.

The active element 22 is attached to a first external surface 30 of the layered dielectric structure 24 and the ground element 23 can be attached to a second external surface 32 of the layered dielectric structure 24 opposite the first external surface 30. The active element 22 is an electrically conductive layer positioned on, or adhered to, the first surface 30 of the layered dielectric structure 24. It is recognised that the active element 22 can cover one or more portions of the first surface 30 or can cover all of the first surface 30, as desired.

Figure 3:
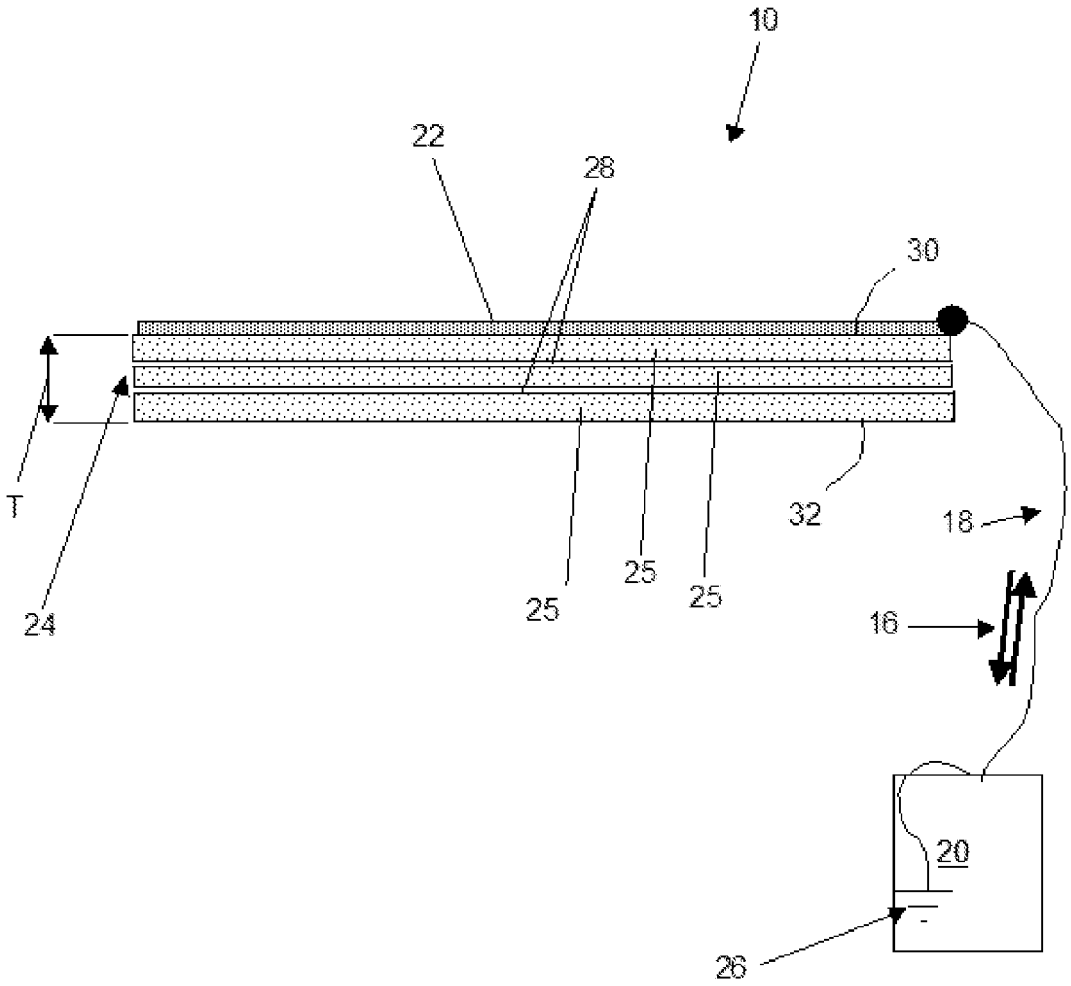
FIG. 3 is a side view of a further embodiment of the antenna of FIG. 1.

The ground element 23 can be positioned as an electrically conductive layer on, or adhered to, the second surface 32 of the layered dielectric structure 24. It is recognised that the ground element 23 can cover one or more portions of the second surface 32 or can cover all of the second surface 32, as desired. Alternatively, the ground element 23 can be a grounding structure 26 that is associated with (or acting as) an electrical ground for the active element 22, which is connected via the transmission line 18 to the radio device 20 (see FIG. 3).

In FIG. 2, the layered dielectric structure 24 of the antenna 10 is composed of at least two, and preferably more, layers 25 of selected RF dielectric material, and the RF dielectric material forming each (or at least a portion thereof) of the respective layers 25 can be the same or different RF dielectric materials. Further, selected pairs of the layers 25 of the dielectric structure 24 can have their opposing surfaces in contact with one another (see FIG. 6) and/or their opposing surfaces can be separated from one another by a gap layer 28 (see FIG. 2) there-between.

In other words, the layered dielectric structure 24 is not a continuous RF dielectric material or medium through a dimension of thickness "T" (comprising the cumulative thickness of the individual layers 25) between the active element 22 and the ground element 23, rather the layered dielectric structure 24 is materially discontinuous between the antenna element 22 and the ground element 23 by being composed of the number of layers 25 in the stacked layer arrangement.

Figure 4:
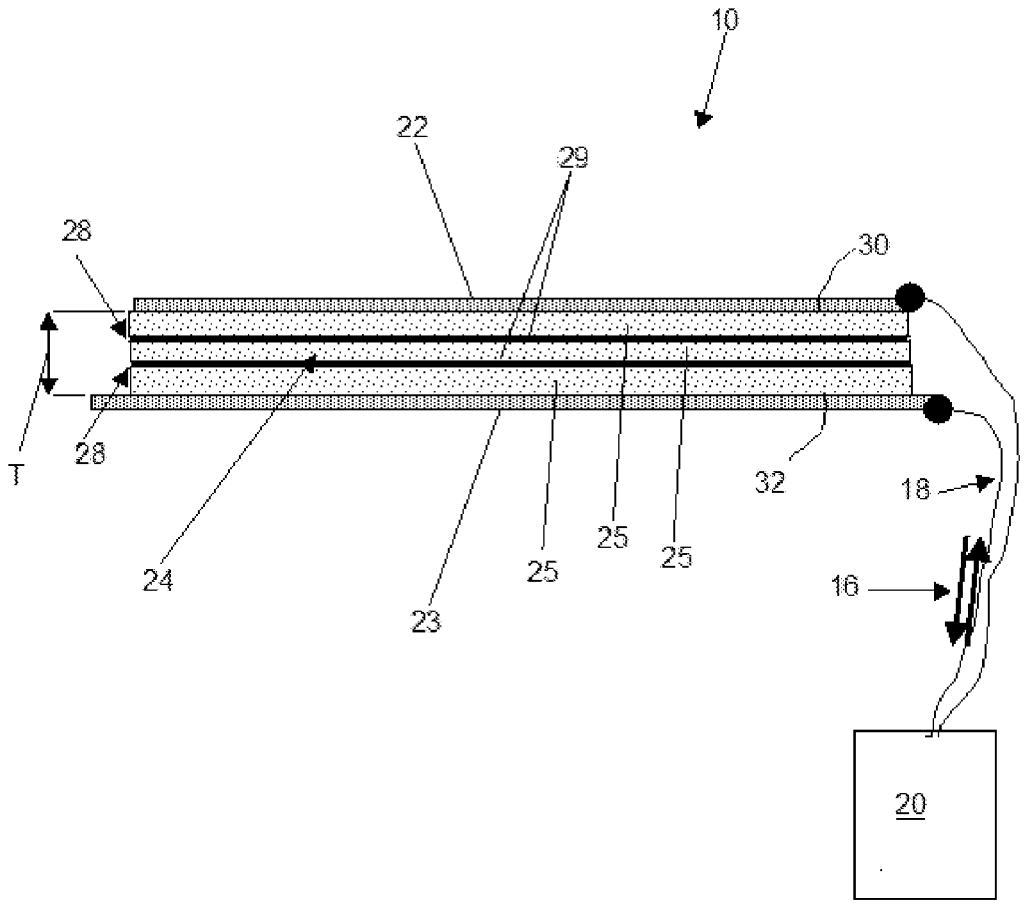
FIG. 4 is a side view of a further embodiment of the antenna of FIG. 1.
Figure 6:
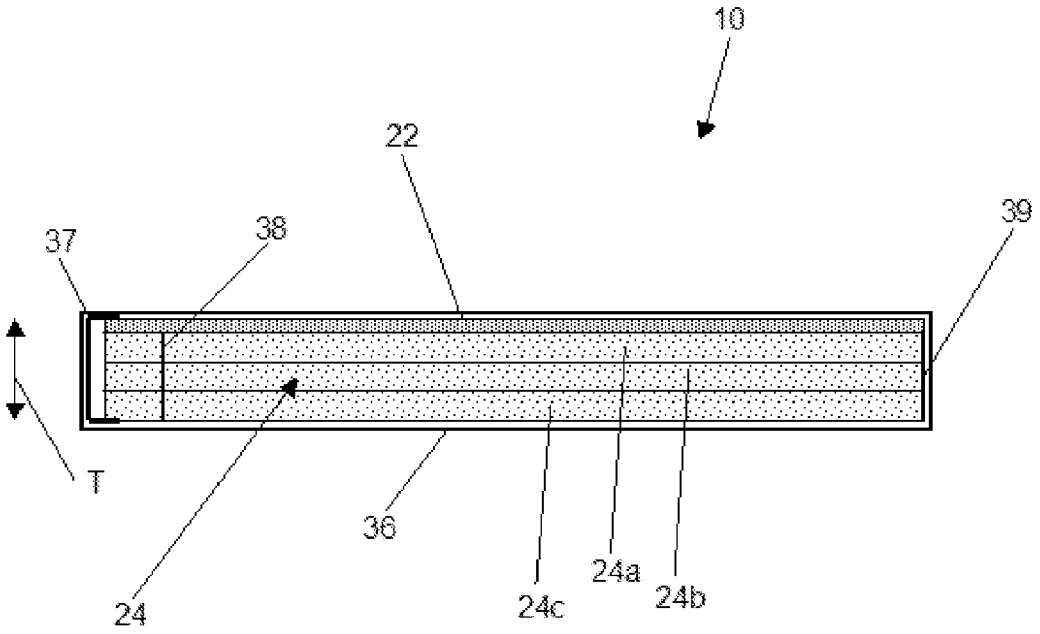
FIG. 6 is a side view of a further embodiment of the antenna of FIG. 1.

It is recognised that: any pair of layers 25 of the layered dielectric structure 24 can be positioned directly adjacent to one another (i.e. their respective opposed surfaces are in direct contact with one another—see FIG. 6; any pair of layers 25 of the layered dielectric structure 24 can be positioned in an opposed, spaced-apart relationship with respect to one another (i.e. their respective opposed surfaces are not in direct contact with one another and are instead separated from one another by the defined space or gap layer 28—see FIGS. 2, 4); or a combination thereof for different pairs of layers 25 of the layered dielectric structure 24.

Figure 5:
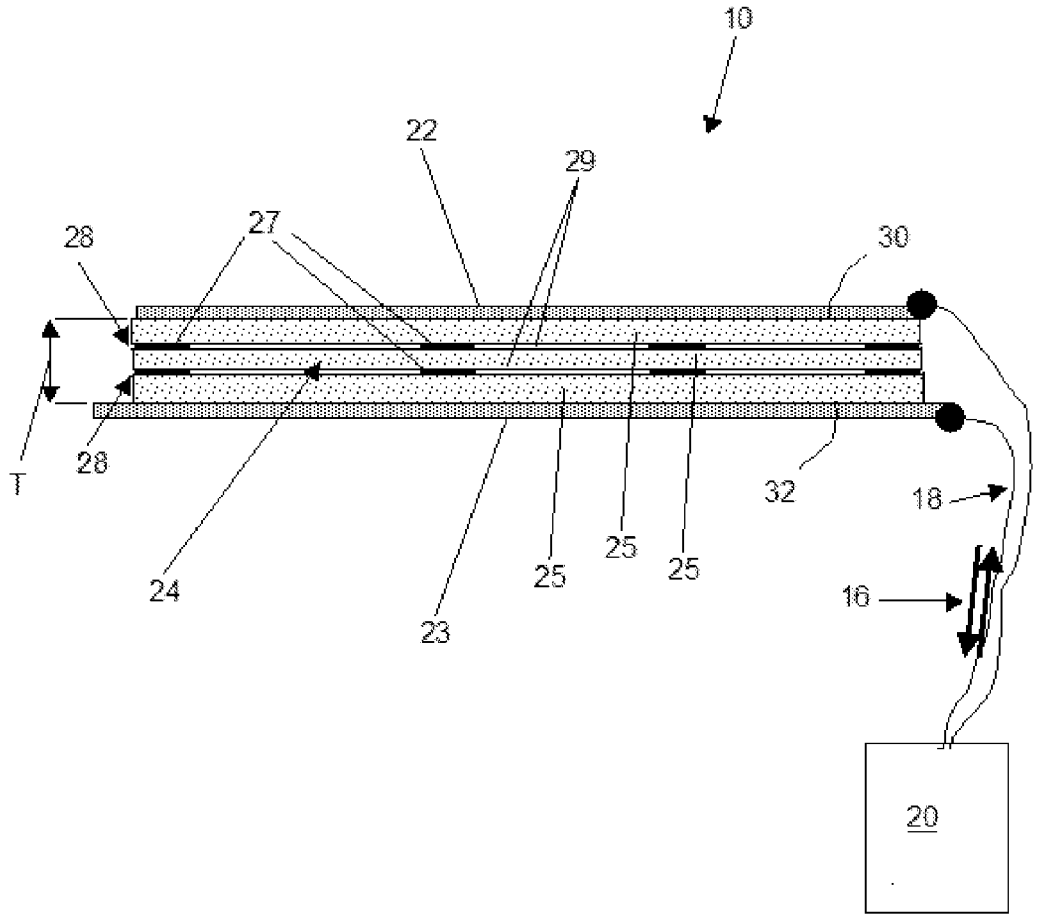
FIG. 5 is a side view of a further embodiment of the antenna of FIG. 1.

In terms of the opposed, spaced-apart, relationship between the pair of layers 25, the gap layer 28 can be constructed in a variety of manners. In a first configuration, gap layer 28 can be "empty" (e.g. filled with air or other gaseous or liquid fluid or can be a vacuum). In another configuration, gap layer 28 can include a number of distributed spacers 27 (see FIG. 5), or a layer of gap material 29 (see FIG. 4), each of which are composed of materials which have a substantially lower dielectric constant $D_k$ and/or higher dissipation factor $D_f$ (e.g. RF unsuitable dielectric material) compared to the dielectric constant and/or dissipation factors of layers 25 of RF dielectric materials. One example of gap material 29 can be an adhesive material (e.g. having a dielectric constant $D_k$ of about 2 to about 4) used to adhere layers 25 to one another. Preferably a gap thickness (e.g. 2 thousands of an inch) of the gap layer 28 is substantially smaller than a layer thickness (e.g. ⅛ inch) of each of the plurality of individual dielectric material layers 25.

If the spacers 27 and/or the gap material 29 have a substantially lower dielectric constant, then they may not function as an RF dielectric material for the operational RF frequency (or frequencies) of the antenna 10, and as such only the RF dielectric material of the layers 25 (and therefore not the gap material 29) have RF suitable $D_k$ for the antenna 10 in RF applications. The dielectric material of the layers 25 is considered RF dielectric material adapted for interacting with the RF electromagnetic radiation 12 in the rated operational RF frequency/frequencies of the antenna 10, as the RF dielectric materials have a suitable $D_f$ for those RF frequencies. This is in comparison to the gap material 29 which is considered as RF unsuitable material for resonating during the transmitting and receiving of the RF electromagnetic radiation 12 in the rated operational RF frequency/frequencies of the antenna 10, as the RF unsuitable material has an unsuitable $D_f$ that results in unacceptable dielectric losses for the antenna 10 during operation in the rated RF frequency/frequencies of the antenna 10.

In other words, the gap material 29 is considered to have a $D_f$ value outside of the acceptable $D_f$ values exhibited by RF dielectric material in the layers 25 of the dielectric structure 24, which is important since the antenna 10 is adapted to resonate in operational RF frequency/frequencies for RF applications. In particular, it is well known that dielectric losses can become more prevalent at higher frequencies (e.g. RF frequencies) and therefore the use of materials considered to have unacceptable $D_f$ (i.e. higher $D_f$) are unsuitable for many RF applications.

Referring now to FIG. 6, in the case where the gap material 29 (see FIG. 5) is not an adhesive, or in the case where there is no gap layer 28 at all, the layers 25 can be coupled to one another as the stacked layer arrangement of the layered dielectric structure 24 by any suitable mechanical fastening mechanism, such as clamps or clips 37 (e.g. positioned external to the stacked layers 25), by fasteners 38 (e.g. threaded fasteners, nut and bolt type fasteners, rivets, etc.) penetrating through the thickness T of the stacked layers 25 of the layered dielectric structure 24, external layers 39 laminated/adhered to the layered dielectric structure 24 (e.g. coupling the external sides of the layers 25 to one another) and/or by a housing 36 (e.g. plastic envelope for the antenna 10). Further, it is recognised that the clamps or clips 37, the fasteners 38, the external layers 39, and/or the housing 36 can be fabricated from non metallic and non conductive material (e.g. plastic, polyethylene or similar) to inhibit shortcutting or short-circuiting of the active element 22 with the ground element 23, which would compromise the antenna 10 performance.

Accordingly, in view of the above, it is recognised that the layered dielectric structure 24 is advantageous with selected RF dielectric properties compatible with RF applications, as the material discontinuity of the layers 25 provides for a higher overall dielectric constant $D_k$ measured for the stacked layer arrangement than would be obtained with a single-block of similar dielectric structure 24 of similar thickness T. In other words, one advantage of constructing the dielectric structure 24 of the antenna 10 of thickness T (as a layered dielectric structure 24 with a cumulative thickness T of multiple layers 25) is a higher measured dielectric constant $D_k$ than what one would measure for the dielectric constant $D_k$ of similar RF dielectric material of a single continuous layer of similar thickness T, further described below. Another advantage for using a layered dielectric structure 24 is that the cost of the RF suitable dielectric material is substantially lower for thinner stock material. For example, ½ inch stock of RF ceramic composite material is approximately 10 times more expensive than ⅛ inch stock. Therefore, a ½ inch thick dielectric element made of one ½ inch layer 25 would be almost double the material cost of an equivalent ½ inch thick dielectric structure 24 made up of four ⅛ inch layers 25.

It is recognised that the dielectric loading of the antenna 10 affects both its radiation pattern and impedance bandwidth. As the dielectric constant $D_k$ of the layered dielectric structure 24 increases, the antenna 10 bandwidth decreases which increases the Q factor of the antenna 10. The RF radiation from the antenna 10 may be understood as a pair of equivalent slots. These slots act as an array and have the highest directivity when the antenna 10 has an air dielectric and decreases as the antenna is loaded by layered dielectric structure 24 material with increasing dielectric constant $D_k$, as further described below for example RF dielectric materials given for the layers 25 and the RF unsuitable gap material 29 for inclusion in the gap layer 28, if present in the layered dielectric structure 24 of the antenna 10.

For example, using a dielectric material of Arlon AD1000 with a $D_k$ of 10.9 gives a larger relative decrease in gain for increasing material thickness T for an antenna configured as a number of increasing layers in the dielectric structure 24. For a single ⅛ inch thick (T) dielectric layer 25, a relative measured (via an EM scanner) radiative power gave a −3.2 dB. In contrast, for two ⅛ inch layers 25 with interposed gap material 29 for adhering the layers 25 to one another gave a relative measure radiative power of −2.9 dB. For three ⅛ inch layers 25 with interposed material 29 for adhering gave a relative measure radiative power of −1.88 dB and for four ⅛ inch layers 25 with interposed gap material 29 for adhering gave a relative measure radiative power of −1.2 dB (demonstrative of almost a 2 dB difference between the one layer 25 and the four layer 25 case).

In another example demonstration, the total thickness of the dielectric structure 24 was kept relatively constant in comparison to an equivalent thickness T of a single layer dielectric element (e.g. one layer element was ½ inch thick, two layers 25 were each ¼ inch thick for ½ inch total and for four layers 25 they were each ⅛ inch thick for ½ inch total in each case). For the demonstration of constant thickness T for the dielectric structure 24, the theoretical dielectric constant $D_k$ for the material is approximately 10.9. The actual measured effective dielectric constant $D_k$ of the dielectric structure 24 with four ⅛ inch layers 25 was approximately 10.67. For two ¼ inch layers the actual measured effective dielectric constant $D_k$ of the dielectric structure 24 was approximately 10.35. This is in comparison to the dielectric constant $D_k$ of a ½ inch thick single layer dielectric element which was actually measured as approximately 10.

Clearly, as shown, one advantage for using multiple layers 25 in the dielectric structure 24 is that the effective (actual measured) dielectric constant $D_k$ of the dielectric structure 24 is higher for more layers 25, as the effect of the layers 25 helps the dielectric structure 24 to more closely approach the theoretical $D_k$ of the RF dielectric material.

Figure 7A:
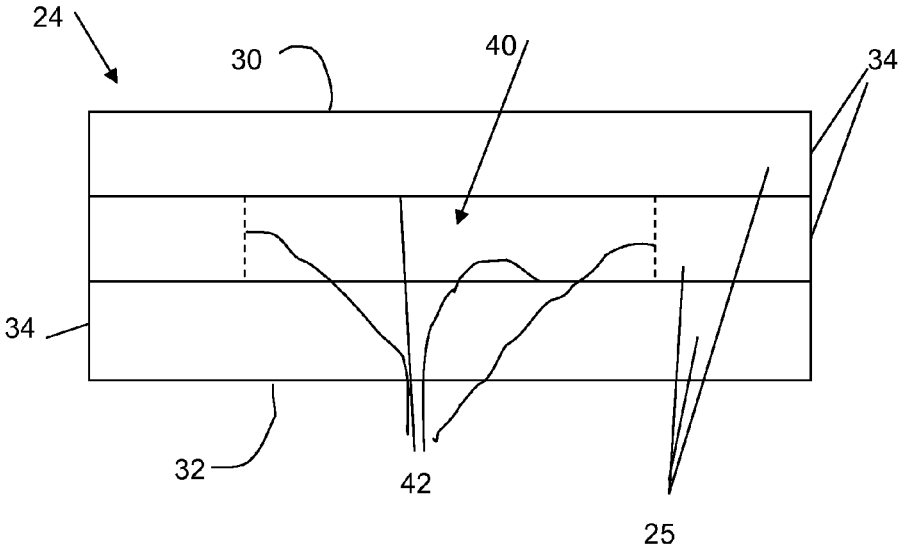
FIG. 7*a* is a side view of a further embodiment of the layered dielectric structure of the antenna of FIG. 1.
Figure 7B:
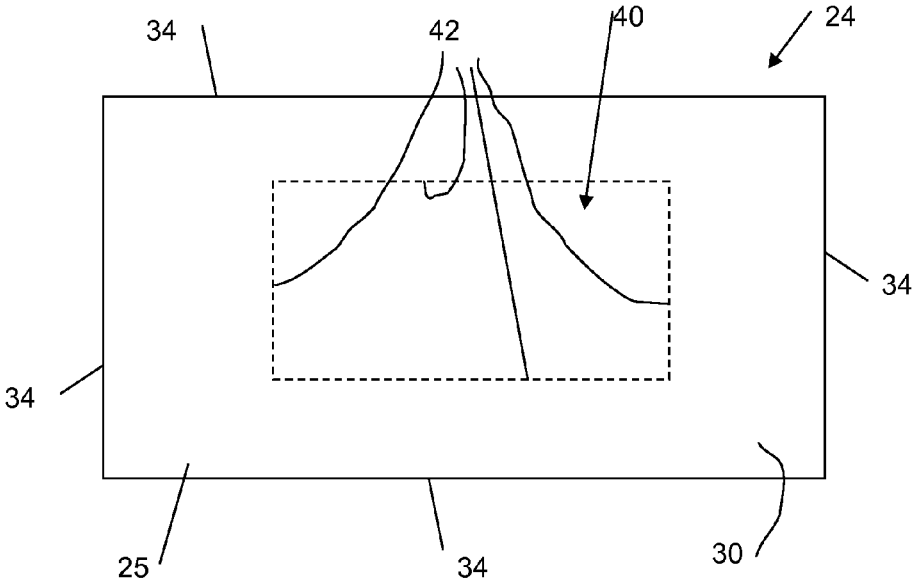
FIG. 7*b* is a top view of the layered dielectric structure of FIG. 7*a;*
Figure 8A:
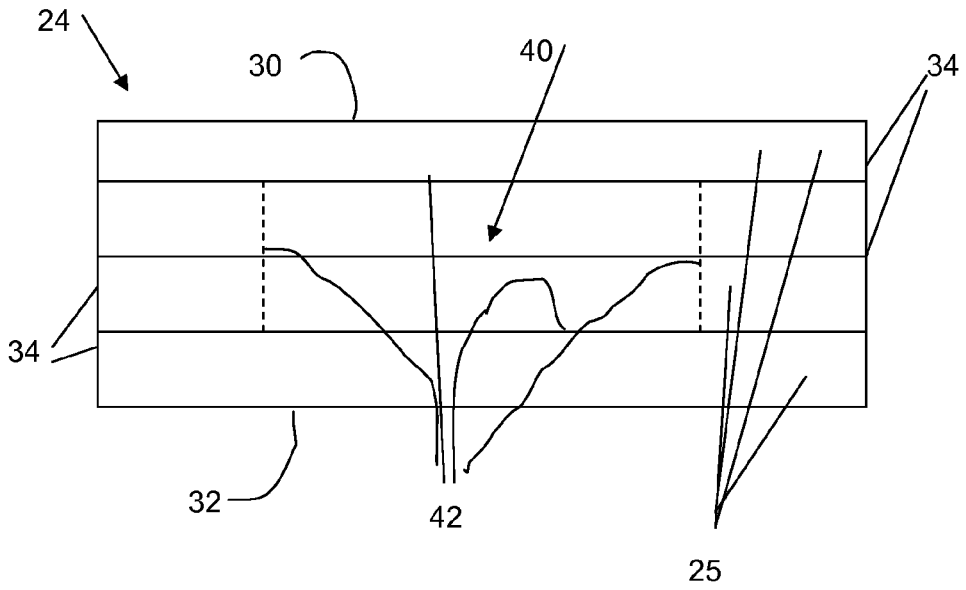
FIG. 8*a* is a side view of a further embodiment of the layered dielectric structure of the antenna of FIG. 1.
Figure 8B:
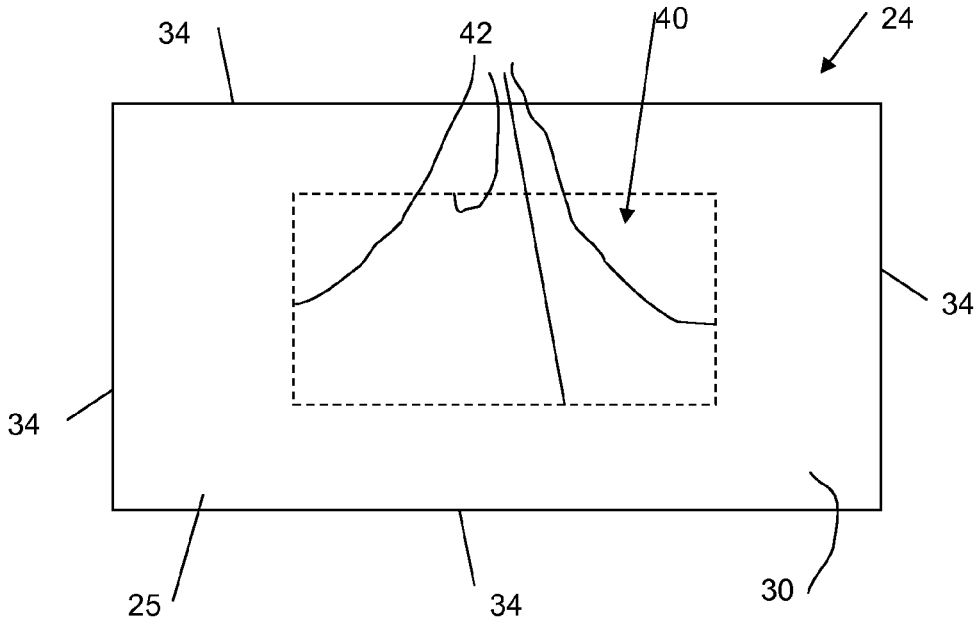
FIG. 8*b* is a top view of the layered dielectric structure of FIG. 8*a;*

Referring now to FIGS. 7*a* and 7*b*, one application of the individual layers 25 of the layered dielectric structure 24 can facilitate vertical positioning (e.g. positioning between the first surface 30 and the second surface 32) of at least one cavity 40 between the first surface 30 and the second surface 32 of the layered dielectric structure 24. The cavity 40 can be positioned in one or more of the layers 25 of the stacked layer arrangement of the layered dielectric structure 24, thus providing for the adaptability of the cavity 40 having a height of a single layer (see FIGS. 7*a* and 7*b*) or cavity 40 having a height of two or more layers (see FIGS. 8*a* and 8*b*) in the layered dielectric structure 24. It is also recognised that the cavity 40 can be positioned in the layer 25 closest to the second surface 32, as desired.

Figure 9A:
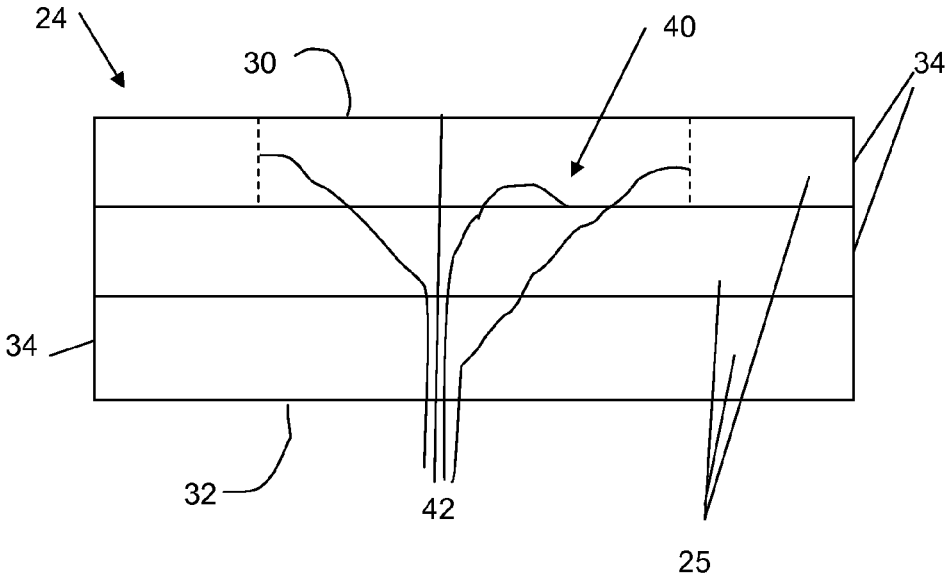
FIG. 9*a* is a side view of a further embodiment of the layered dielectric structure of the antenna of FIG. 1.
Figure 9B:
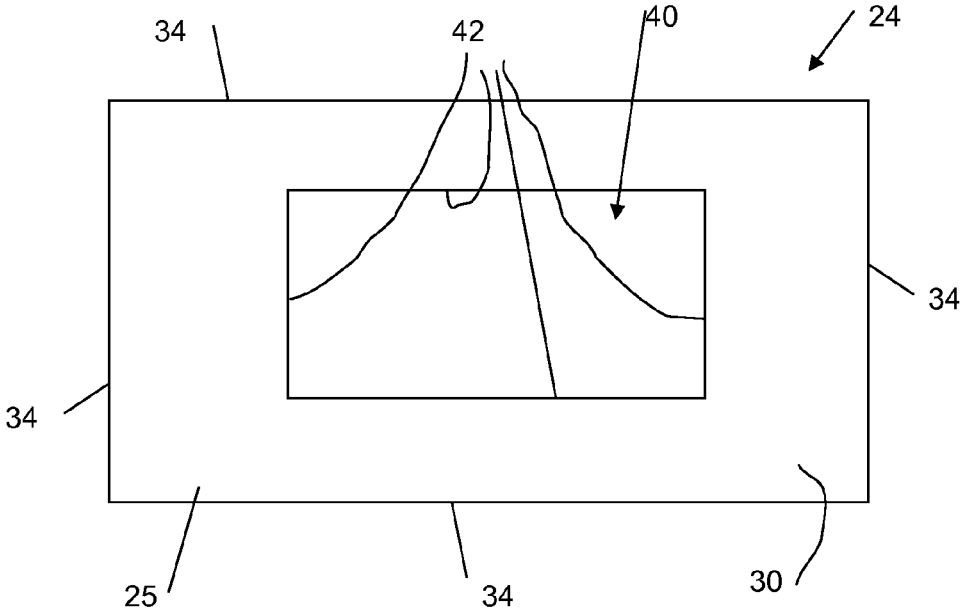
FIG. 9*b* is a top view of the layered dielectric structure of FIG. 9*a;*
Figure 10A:
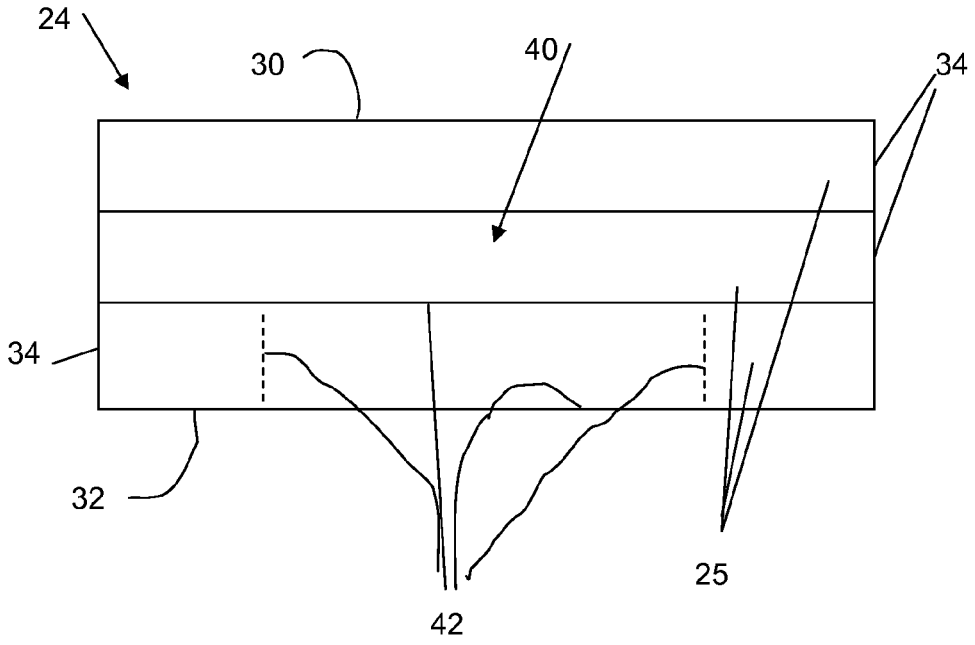
FIG. 10*a* is a side view of a further embodiment of the layered dielectric structure of the antenna of FIG. 1.
Figure 10B:
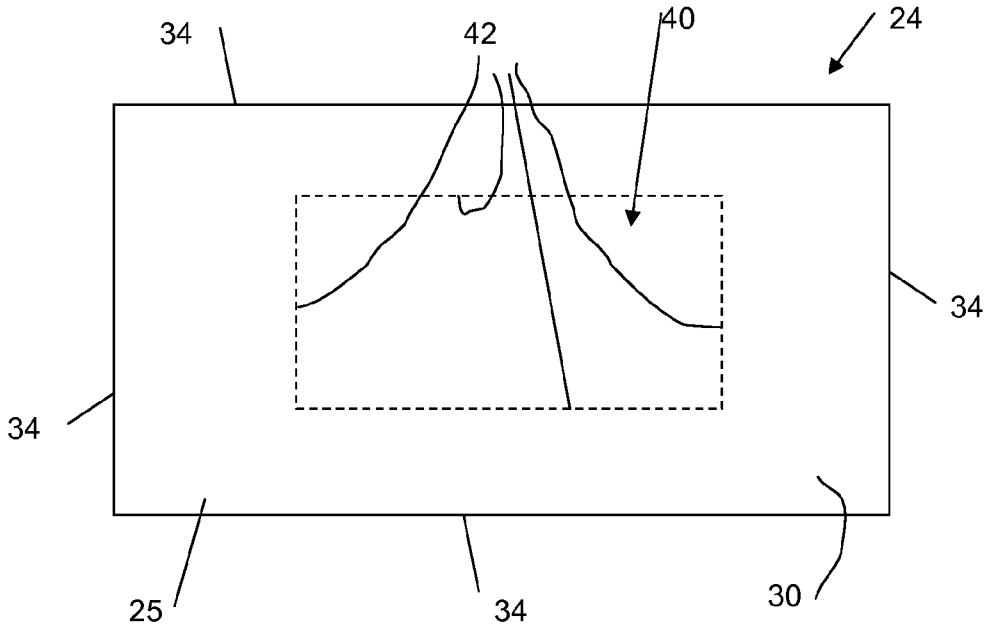
FIG. 10*b* is a top view of the layered dielectric structure of FIG. 10*a;*

Further, it is contemplated that the cavity 40 can be positioned completely within the layered dielectric structure 24 (see FIGS. 7*a* and 7*b*), such that one or more of the layers 25 are positioned directly above and below the layer 25 (or layers 25) containing the cavity 40. Alternatively, the cavity 40 can be positioned in the layer 25 adjacent to the first surface 30 (see FIGS. 9*a* and 9*b*) or can be positioned in the layer 25 adjacent to the second surface 32 (see FIGS. 10*a* and 10*b*).

Figure 11A:
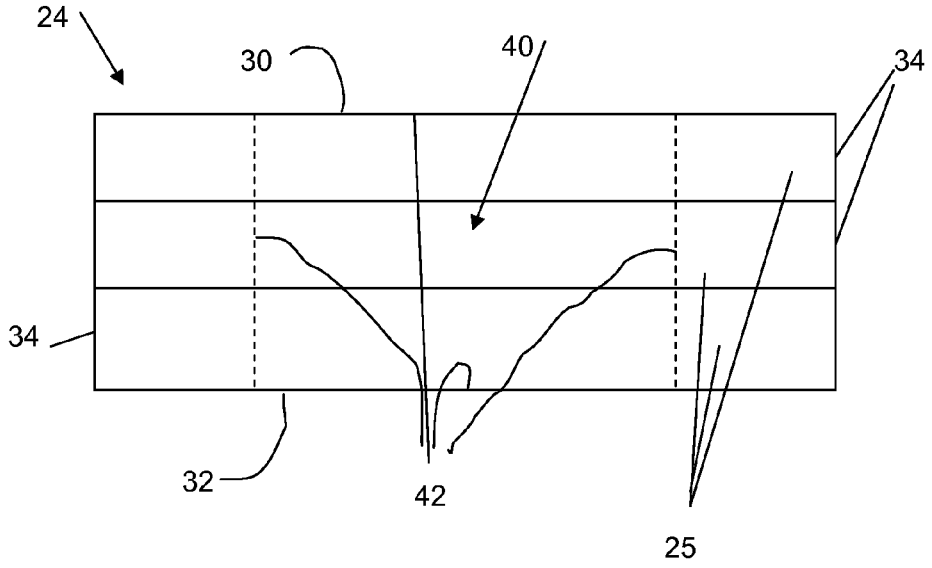
FIG. 11*a* is a side view of a further embodiment of the layered dielectric structure of the antenna of FIG. 1.
Figure 11B:
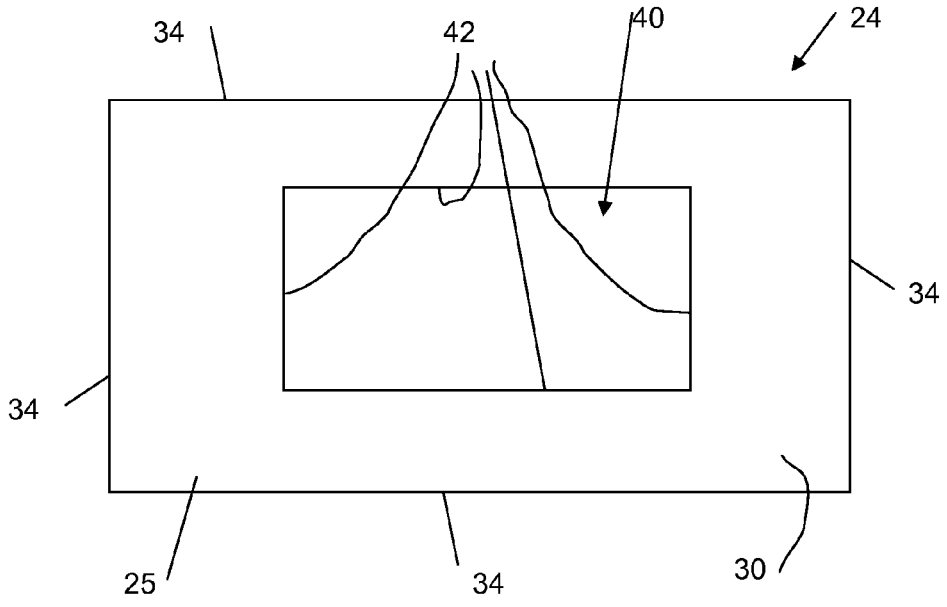
FIG. 11*b* is a top view of the layered dielectric structure of FIG. 11*a;*

Another alternative is for the cavity 40 to extend through all of the layers 25 from the first surface 30 to the second surface 32 of the layered dielectric structure 24 (see FIGS. 11*a* and 11*b*).

However, it is also contemplated that, in most circumstances, it will be preferred that the cavity 40 is positioned in the stacked layer arrangement, such that one or more layers 25 of the RF dielectric material are situated between the cavity 40 and the first surface 30. Accordingly, as the thickness of the dielectric structure 24 increases between the cavity 40 and the active element 22, the performance of the antenna 10 can more closely mirror that of the antenna 10 without the cavity 40.

Figure 12A:
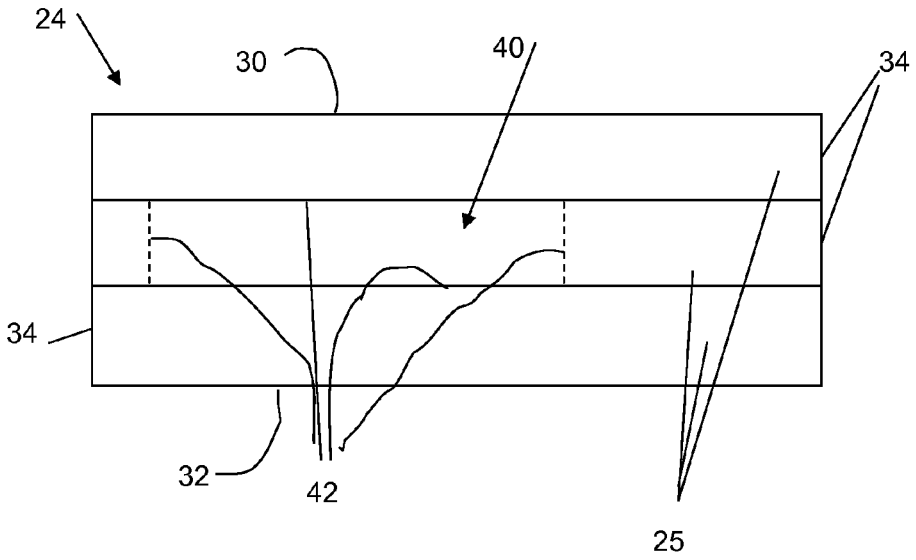
FIG. 12*a* is a side view of a further embodiment of the layered dielectric structure of the antenna of FIG. 1.
Figure 12B:
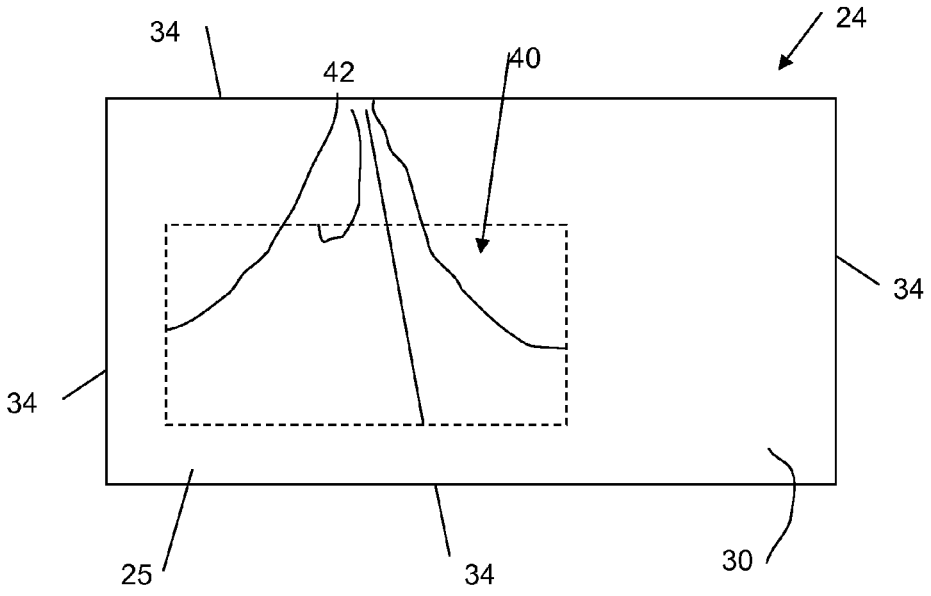
FIG. 12*b* is a top view of the layered dielectric structure of FIG. 12*a;*

Referring to FIGS. 7*a*, 7*b*, 8*a*, 8*b*, 9*a*, 9*b*, 10*a*, 10*b*, 11*a*, and 11*b*, in terms of lateral positioning of the cavity 40 in the layer 25 with respect to the lateral surfaces 34 of the layered dielectric structure 24, the cavity 40 is positioned internally to the respective layer 25. In other words, walls 42 of the cavity 40 are positioned away from the lateral surfaces 34 of the layer 25, such that the layer 25 with cavity 40 is enclosed within the layer 25. It is recognised that the distances between the walls 42 and the lateral surfaces 34 can be symmetrical such that the cavity 40 is positioned in the center of the layer 25. Alternatively, it is recognised that the distances between the walls 42 and the lateral surfaces 34 can be asymmetrical such that the cavity 40 is positioned off-center of the layer 25 (see FIGS. 12*a* and 12*b*).

Figure 13A:
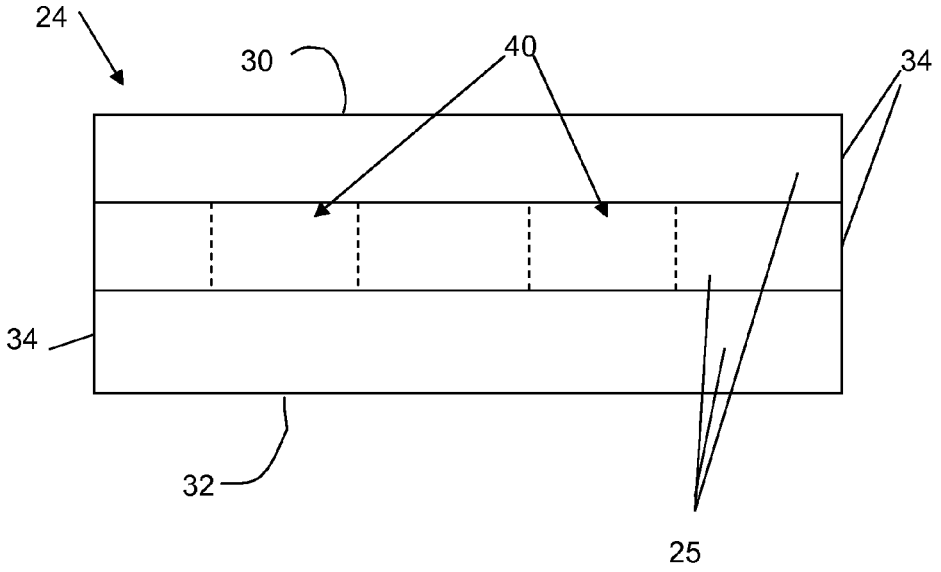
FIG. 13*a* is a side view of a further embodiment of the layered dielectric structure of the antenna of FIG. 1.
Figure 13B:
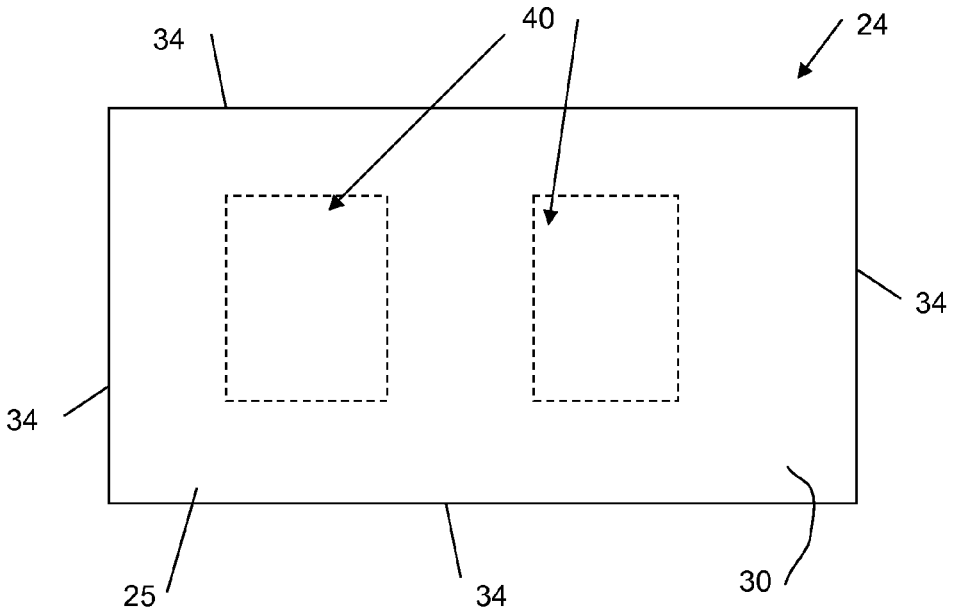
FIG. 13*b* is a top view of the layered dielectric structure of FIG. 13*a;*
Figure 14A:
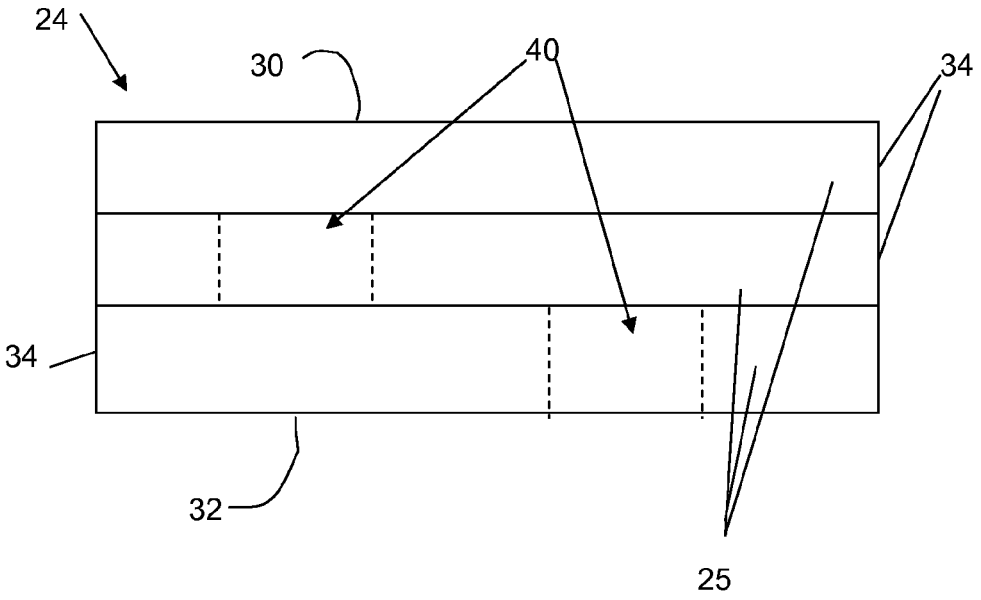
FIG. 14*a* is a side view of a further embodiment of the layered dielectric structure of the antenna of FIG. 1.
Figure 14B:
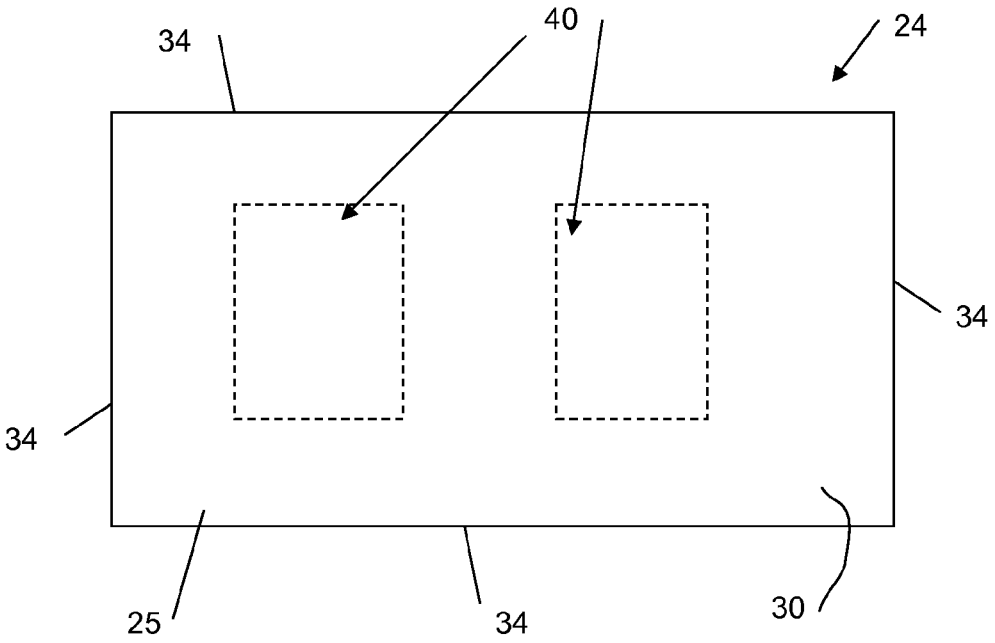
FIG. 14*b* is a top view of the layered dielectric structure of FIG. 14*a;*
Figure 15A:
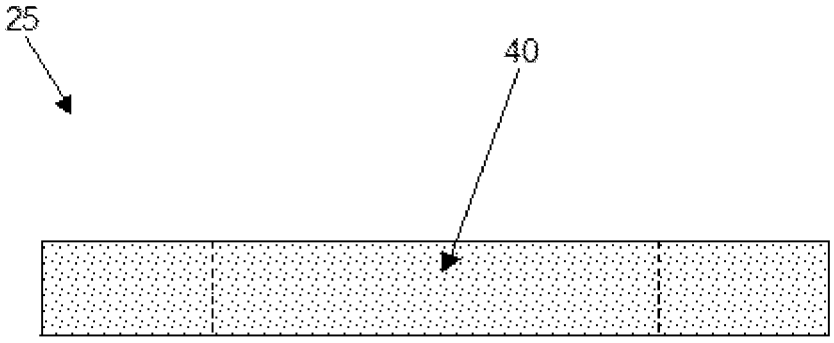
FIG. 15*a* is a side view of a layer construction of the layered dielectric structure of the antenna of FIG. 1.
Figure 15B:
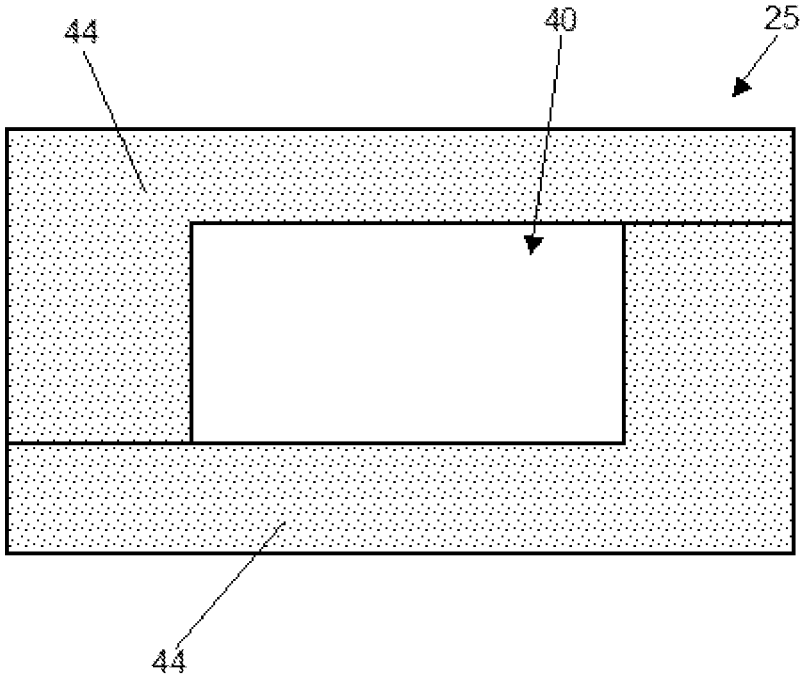
FIG. 15*b* is a top view of the layer construction of FIG. 15*a;*
Figure 16A:
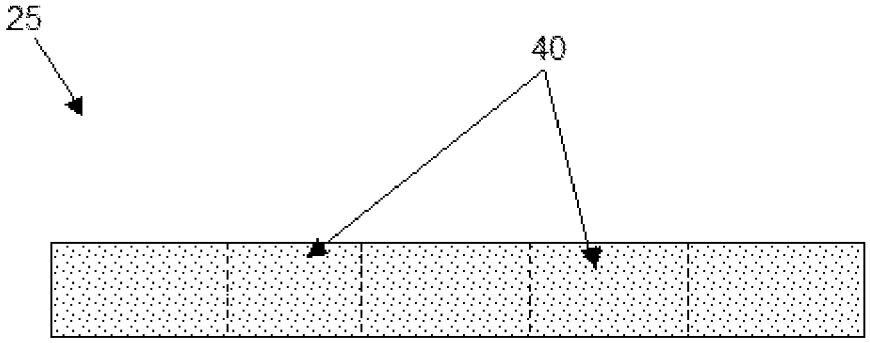
FIG. 16*a* is a side view of a further embodiment of the layer construction of the layered dielectric structure of the antenna of FIG. 1.
Figure 16B:
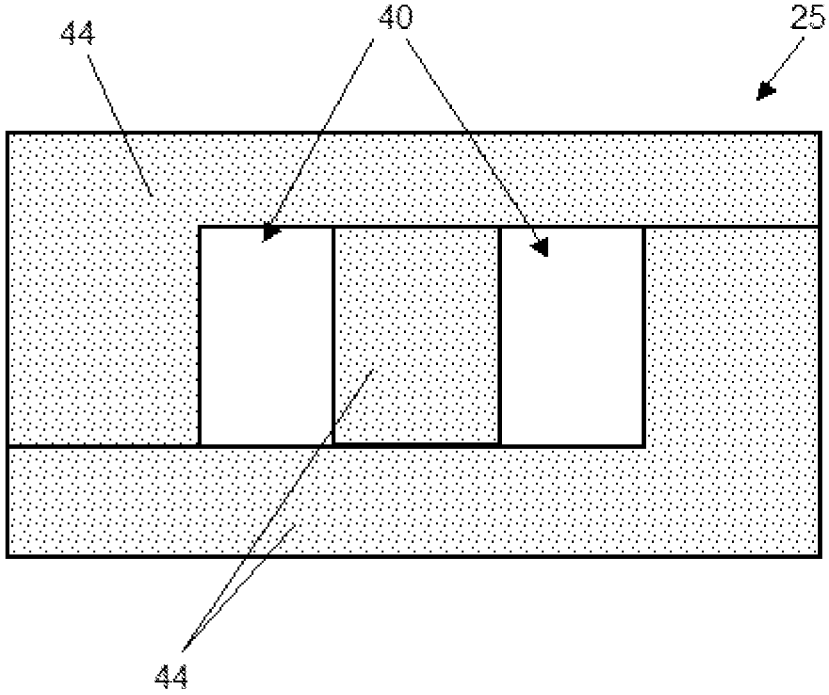
FIG. 16*b* is a top view of the layer construction of FIG. 16*a;*

A further alternative is to have at least two individual cavities 40 positioned in the same layer 25, as shown by example in FIGS. 13*a* and 13*b* or in different layers 25 as shown in FIGS. 14*a* and 14*b*.

Referring to FIGS. 15*a*, 15*b*, 16*a* and 16*b*, in construction of the cavity 40 in a selected layer 25 of the stacked layer arrangement of the layered dielectric structure 24, the selected layer 25 can be comprised of one or more pieces 44 of the RF dielectric material that resemble different shapes, preferably planar shapes. These pieces 44 can be in the shape of an "L", a square, a rectangle, other irregular shapes, or other compound shapes (e.g. shapes containing arcuate surfaces), that when assembled as the layer 25, provide for or otherwise form the desired shape and lateral position of the cavity 40 in the layer 25.

Figure 17A:
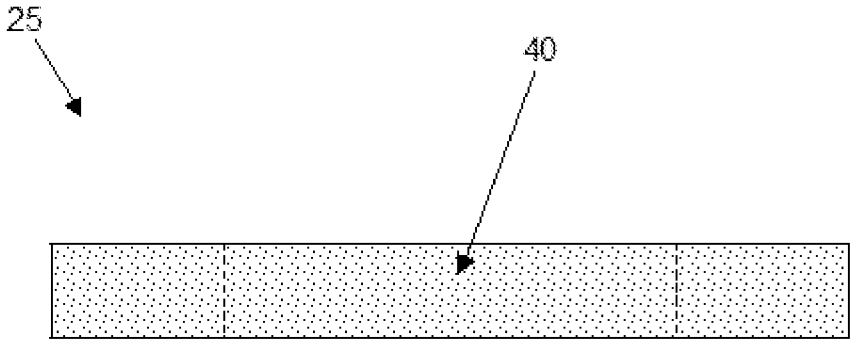
FIG. 17*a* is a side view of a further embodiment of the layer construction of the layered dielectric structure of the antenna of FIG. 1.
Figure 17B:
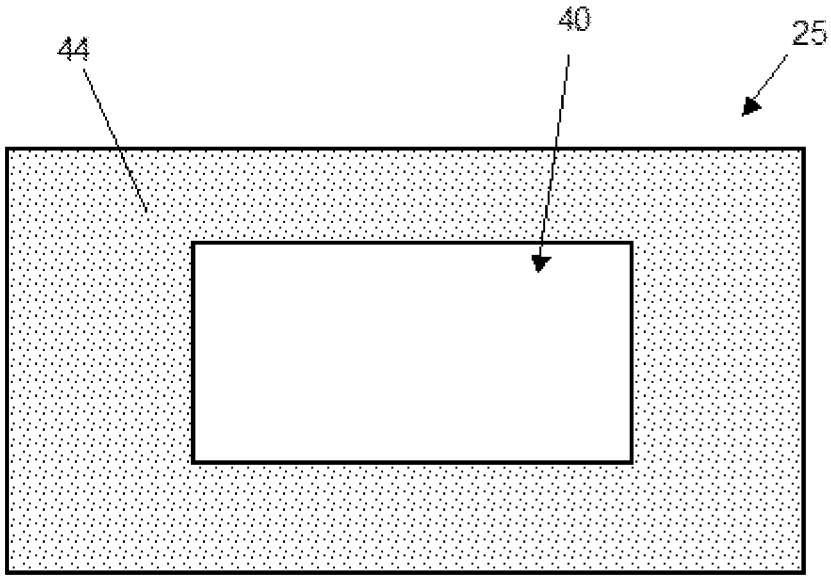
FIG. 17*b* is a top view of the layer construction of FIG. 17*a;*
Figure 18A:
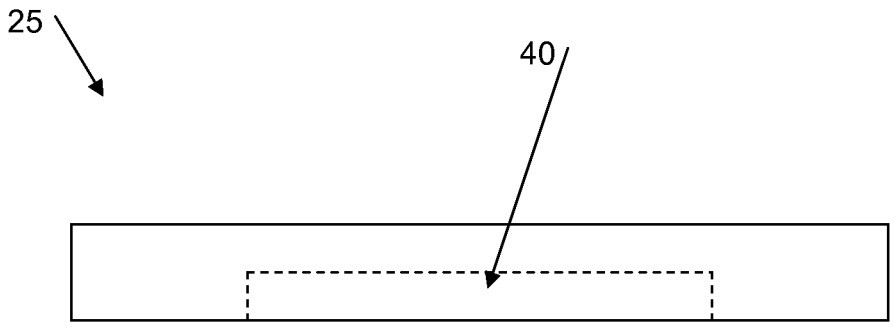
FIG. 18*a* is a side view of a further embodiment of the layer construction of the layered dielectric structure of the antenna of FIG. 1.
Figure 18B:
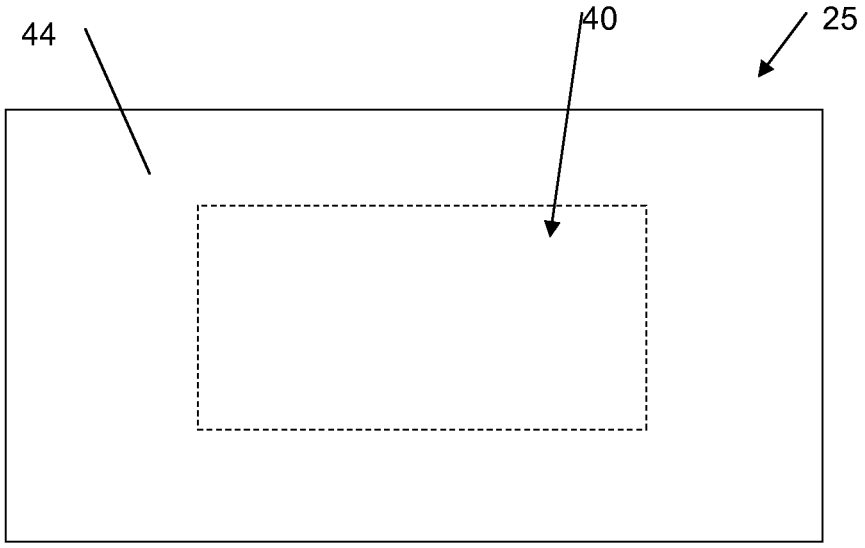
FIG. 18*b* is a top view of the layer construction of FIG. 18*a;*

One advantage of assembling the layer 25 as a collection of individual pieces 44 is that waste cut-offs of the RF dielectric material can be minimized (e.g. a regular sheet of dielectric material can be used to form a series of "L" shaped pieces to minimize wastage of the sheet) when forming the cavities 40. Alternatively, the cavity 40 can be carved, milled or otherwise formed out of a one piece layer 25, if desired (see FIGS. 17*a* and 17*b*). In the case of a carved or otherwise formed cavity 40, it is recognised that the cavity may only extend partway through the layer 25, as shown in FIGS. 18*a* and 18*b*.

Another advantage for including one or more cavities 40 in the stacked layer arrangement of the layered dielectric structure 24 is to help reduce the material cost of the layered dielectric structure 24, as less RF dielectric material is used to construct the layered dielectric structure 24. Another advantage for including one or more cavities 40 in the stacked layer arrangement of the layered dielectric structure 24 is to help reduce the overall weight of the layered dielectric structure 24. As will be apparent to those of skill in the art, the presence of cavities 40 in the dielectric structure 24 does not substantially effect the overall performance of the antenna 10, as the radiation mechanism of the antenna 10 is more concentrated near the presence of discontinuities (e.g. near the lateral surfaces 34) and edges of the antenna 10. Therefore the presence of one or more appropriately placed cavities 40 does not overly affect the performance of the antenna 10, as the electrical field of the electromagnetic radiation 12 are concentrated around the edges of the antenna 10.

In another embodiment, the cavity 40 can be formed in a layer 25 of a first RF dielectric material having a first dielectric constant $D_{k1}$, such that the cavity 40 is filled with second RF dielectric material having a second dielectric constant $D_{k2}$. In this arrangement, first dielectric constant $D_{k1}$ is greater than the second dielectric constant $D_{k2}$. One advantage to this filled cavity 40 arrangement is that higher $D_k$ dielectric material is generally more expensive than lower $D_k$ dielectric material, and as such the interior (i.e. portion of the dielectric structure 24 away from the lateral surfaces 34) of the dielectric structure 24 can be filled with lower cost RF dielectric material while the higher cost RF dielectric material is positioned about the edges (i.e. lateral surfaces 34) of the dielectric structure 24 where the radiation mechanism of the antenna 10 is more concentrated. It is recognised that this embodiment can be used for any of the above described cavity 40 placement variations in the dielectric structure 24.

In another embodiment, the cavity 40 can be formed in a layer 25 of RF dielectric material having a first dielectric constant $D_{k1}$ and a first dissipation factor $D_{f1}$, such that the cavity 40 is filled with RF unsuitable material (preferably having a second dielectric constant $D_{k2}$ lower than the first dielectric constant $D_{k1}$ and/or a second dissipation factor $D_{f2}$ higher than the first dissipation factor $D_{f1}$). One advantage to this filled cavity 40 arrangement is that RF unsuitable material is generally less expensive than RF dielectric material. It is recognised that this embodiment can be used for any of the above described cavity 40 placement variations in the dielectric structure 24.

As described above, the layered dielectric structure 24 provides an unshielded dielectric resonator for RF applications, such that the layered dielectric structure 24 is used in the antenna 10 to facilitate the generation and reception of RF electromagnetic radiation by the antenna 10 at the rated RF frequency or frequencies of the antenna 10. The layered dielectric structure 24 is composed of the plurality of layers 25 (e.g. two or more) including one or more selected RF dielectric materials (e.g. different layers 25 can include the same or different RF dielectric materials as other(s) of the layers 25), such that selected pairs of the dielectric layers 25 (adjacent to one another) are physically discontinuous from one another. It is recognised that each layer 25 can include two or more different RF dielectric materials (e.g. different material types having the same or different dielectric constant or the same material type having different dielectric constants).

In other words, the material of the dielectric layers 25 are physically discontinuous from one another in a stacked layer arrangement. A stack is considered a pile or collection of objects (i.e. layers 25), such the next object (i.e. layer 25) in the stack is positioned adjacent to (e.g. on top of) the last object (i.e. layer 25) in the stack. The dielectric properties of the layered dielectric structure 24, comprising the plurality of layers 25, functions as electrically insulating material(s) positioned between the active element 22 (e.g. plate) and the ground element 23 (or equivalent) of the antenna 10, while at the same time providing for RF dielectric materials with suitable $D_f$ for resonance of the dielectric structure 24 in the rated operational RF frequencies of the antenna 10.

As described above, one or more pairs of the individual layers 25 can be positioned directly adjacent to and in contact with one another (i.e. the opposing surfaces of adjacent layers 25 are in direct contact with one another). Alternatively, one or more pairs of the adjacent individual layers 25 of RF dielectric material may be spaced apart from one another, i.e. have the defined gap 28 between the opposing surfaces (e.g. the entire opposing surfaces or at least a portion of the entire opposing surfaces) of the adjacent individual layers 25, such that the opposing surfaces of the adjacent layers 25 are not in direct contact with one another. It is important to note that defined gap 28 does not contain any active elements 22 or ground elements 23, which are defined as being comprised of electrically conductive material (e.g. copper, ferromagnetic material, etc.), considered non-dialectic materials. Preferably, the ground element 23 can be composed of ferromagnetic material such as but not limited to steel or solderable steel (e.g. tin coated steel). Further, it is recognised that the ground element 23 attached to the second surface 32 can comprise a copper layer and a layer of tin coated steel soldered to the copper layer.

The defined gap layer 28, if present, can contain other gap materials 29 (e.g. air, foam, adhesive or other adhering agent, etc.) that are hereby defined as RF unsuitable material for affecting the performance of the antenna 10 in the selected operational RF frequency or frequencies "$f_r$", further defined below. In other words, the gap material 29 and/or vacant gap layer 28 is considered to contain RF unsuitable material having a $D_f$ outside of the acceptable $D_f$ for RF dielectric materials compatible with operational RF frequency or frequencies of the antenna 10. For example, the measured dissipation factor $D_f$ of the gap material 29 can be $D_f$ greater than 0.011 and preferably greater than 0.02 for materials other than high frequency RF dielectric material (further discussed below). Further, the measured dielectric constant $D_k$ of the gap material 29 can be $D_k$ from about 1.0 to about 5.0 and preferably from about 1.0 to about 3.0 for materials other than high frequency RF dielectric material (further discussed below). Further, the gap material 29 can also be considered as a non-high frequency, RF unsuitable material. Further, the gap material 29 can also considered as a non-ceramic compound material or a non-ceramic composite material (further discussed below).

It is recognised that for desired operational RF frequencies of the antenna 10, the selected RF dielectric material(s) of the layers 25 can have a range of dielectric constant $D_k$ values. In the case of the antenna 10, the dielectric constant $D_k$ values for the selected dielectric material(s) of the layers 25 can be from about $D_k$=2.0 to about $D_k$=100, or more preferably from about $D_k$=4.0 to about $D_k$=50, or more preferably from about $D_k$=4.5 to about $D_k$=30, or more preferably from about $D_k$=5.0 to about $D_k$=20.0, or more preferably from about $D_k$=7.0 to about $D_k$=12.0, or more preferably from about $D_k$=8.0 to about $D_k$=15.0. As will be apparent to those of skill in the art, higher values of $D_k$ are preferred over lower values, but the cost of dielectric materials, suitable for use in antenna 10, can increase substantially as $D_k$ increases.

RF suitable dielectric material, compatible for use in manufacturing of the layers 25 and the resultant RF compatible dielectric structure 24, has many beneficial material characteristics for operation in the desired RF frequency range of the antenna 10 (e.g. general RF frequencies from about 300 MHz up to 14 GHz), including favourable dissipation factor $D_f$ values and stability.

Every material has a measurable dissipation factor $D_f$. As a consequence, the conversion of RF electromagnetic radiation into heat energy can cause an undesirable increase in temperature in the dielectric material (e.g. dielectric structure 24) between the conductors (e.g. active element 22 and ground element 23) of the antenna 10. Therefore, for higher dissipation factors $D_f$, more power (e.g. from the power source 52 during transmission of RF electromagnetic radiation 12, see FIG. 19*a*) is converted into heat energy, which is undesirably dissipated into the surrounding medium (i.e. dielectric structure 24, active element 22 and ground element 23). A disadvantage of higher operating temperatures of the antenna 10 is a decrease in the efficiency (e.g. gain) of the antenna 10, including the undesirable impact of decreasing the dielectric constant $D_k$ and increasing the dissipation factor $D_f$ values of the dielectric material, as these values themselves can be temperature dependent.

Further, stable impedance for dielectric materials depends on maintaining a stable dielectric constant $D_k$ across the length and width of the dielectric material. In this regard, FR-4 materials can suffer relatively wide variations in $D_k$ across the dimensions (e.g. length and width) of a circuit board during manufacture, as well as variation in $D_k$ between different batches of FR-4 material. In comparison, RF grade dielectric materials (e.g. high frequency laminates), provide a $D_k$ that can remain constant across the length and width of a layer 25 and between material batches (preferential for antenna 10 design), which means more predictable performance in the antenna 10.

In summary of the above, the dielectric material preferably used in manufacture of the layers 25 is defined as RF dielectric material, which is compatible for use in the dielectric structure 24 since the RF dielectric material has the preferred dielectric material characteristics of (as compared to RF unsuitable materials): lower dissipation factor $D_f$; stable and consistent dielectric constant $D_k$ across differing operational frequency of the antenna 10; and controlled dielectric constant $D_k$ due to controlled dielectric tolerance during manufacture of the dielectric material (e.g. between material batches and within the material itself from the same batch), resulting in predictable higher frequency (e.g. RF and higher frequencies) performance of the antenna 10 when consistent $D_k$ dielectric material are used in dielectric structure 24 manufacture.

In terms of the dissipation factor Df, acceptable ranges for RF suitable dielectric materials can be $D_f$ up to 0.01; more preferably $D_f$ up to about 0.008; more preferably $D_f$ up to about 0.006; more preferably $D_f$ up to about 0.005; and, more preferably $D_f$ up to about 0.004.

For example, RF dielectric material RO4000™ is a woven glass reinforced, ceramic filled thermoset material with dissipation factor $D_f$ ranging between 0.0021 to 0.0037, depending upon formulation and test conditions (e.g. for 23 Celcius and 2.5/10 GHz using test method IPC-TM-650 2.5.5.5). Another RF material is Taconic™ RF laminates such as CER-10 RF & Microwave Laminate. The CER-10 dielectric material has a dielectric constant $D_k$ at 10 GHz of 10 based on a test method of IPC TM 650 2.5.5.6 and has a dissipation factor $D_f$ of 0.0035 using the test method at 10 GHz of IPC-TM-650 2.5.5.5.1. Arlon Materials for Electronics (MED) have RF suitable dielectric materials with dissipation factors $D_f$ in the range of about 0.0009 to about 0.0038.

In view of the above, it is recognised that material which is unsuitable in manufacture of the layers 25 and resulting dielectric structure 24 is defined as RF unsuitable material. More specifically, RF unsuitable materials (as compared to RF dielectric materials) have: a considered higher dissipation factor $D_f$; a considered unstable and inconsistent dielectric constant $D_k$ across differing operational frequency of the antenna 10; and a considered uncontrolled dielectric constant $D_k$ due to uncontrolled dielectric tolerance during manufacture of the material.

For example, variation in the dielectric constant $D_k$ for RF unsuitable materials such as bulk FR materials can be between $D_k$=4.4 to $D_k$=4.8, an approximate 10% difference. In particular, it is recognised that FR type laminates (e.g. FR-4) have higher a dissipation factor $D_f$ than RF suitable dielectric materials. Typical $D_f$ values for FR material are around 0.02, which can translate into a meaningful, and unacceptable, difference in dielectric loss inside of the material. Further, it is recognised that FR type materials experience increasing $D_f$ with increasing frequency, so as frequency rises so does loss.

It is recognised that the selected RF dielectric material(s) of the layers 25 for the antenna 10 can be defined dependent upon the type of RF dielectric material, for example in addition to, or separate from, the dielectric constant $D_k$ values for the layers 25 as defined above. In other words, it is recognised that each type of RF dielectric material can have a characteristic set of dielectric constant $D_k$ values, dependant upon the composition of the material (e.g. constituent components) and/or upon the manufacturing or forming process (e.g. manufacturing parameters such as pressure, temperature, as well as overall forming process such as casting, sintering, etc.) of the dielectric material. It is recognised that there are many different kinds of RF dielectric materials that can be chosen for use in the layers 25, as further described below. In particular, as is well known, RF dielectric materials exhibit desired lower dissipation factors $D_f$ as compared to other RF unsuitable materials.

One example RF suitable dielectric material for use as one or more of the layers 25 are ceramic compound materials, or a mixture of ceramic compound materials (i.e. ceramic composite materials), which can be formed by casting or sintering techniques using ceramic materials only, as is known in the art. One advantage of the ceramic compound materials or ceramic composite materials is that they can have large dielectric constant $D_k$ values (e.g. typically greater than $D_k$>100), however these materials can also be expensive, can be relatively brittle and prone to damage by themselves, can be difficult to work once formed (e.g. machinability such as cutting, drilling, etc.) during manufacture of the antenna 10, and/or can be relatively heavy in comparison to other dielectric materials available.

However, the relatively large dielectric constant $D_k$ values of the ceramic compound materials or ceramic composite materials, as compared to composite polymer resin systems (further described below), can make the ceramic compound materials or ceramic composite materials suitable for use as the dielectric material in one or more of the layers 25.

One example application of the ceramic compound materials or ceramic composite materials in the layered dielectric structure 24 is providing the ceramic compound materials or ceramic composite materials in (at least a portion of) one or more of the layers 25 in combination with one or more of the layers 25 including (at least a portion of) composite polymer resin systems, further described below. In this arrangement, the layers 25 have at least one layer 25 including ceramic compound (or composite) material and at least one layer 25 including non-ceramic compound (or composite) material (e.g. a composite polymer resin system), which can provide an advantage of combining the higher dielectric material of the ceramic compound (or composite) material with the associated durability of the non-ceramic compound (or composite) material.

The combination of ceramic compound (or composite) material with non-ceramic compound (or composite) material in the layers 25 can also provide an advantage for better machinability of the ceramic compound (or composite) material during manufacture of the layered dielectric structure 24, including dielectric structure sizing and drilling of holes in the layered dielectric structure 24, for example.

One example configuration based on this combination of ceramic compound (or composite) materials with composite polymer resin systems is the layered dielectric structure 24 comprising at least two layers 25 adhered together by an adhesive layer (i.e. gap material 29) provided in the defined gap 28 between the two layers 25, such that one of the layers 25 includes a RF dielectric material selected as a ceramic compound (or composite) material and the other layer 25 includes a RF dielectric material selected as a composite polymer resin systems, e.g. ceramic filled such as a polytetrafluoroethylene (PTFE) (also known as Teflon™) ceramic filled high frequency dielectric material.

A further example configuration based on this combination of ceramic compound (or composite) materials with composite polymer resin systems is the layered dielectric structure 24 comprising at least three layers 25, each adjacent layer 25 adhered to one another by an adhesive layer (i.e. the gap material 29) provided in the defined gaps 28 between the adjacent layers 25, such that the central layer 25 of the layers 25 includes a dielectric material selected as a ceramic compound (or composite) materials and the other two outside layers 25 include dielectric materials selected as a composite polymer resin systems (e.g. ceramic filled such as a Teflon™ ceramic filled high frequency dielectric material). It is recognised that the two outside layers 25 can include composite polymer resin systems made of the same or different dielectric materials. As discussed above, layers 25 having lower $D_k$ values may contain two or more different types of RF dielectric material, such that the lower $D_k$ material is positioned away from the lateral edges 34 of the dielectric structure 24 while the higher $D_k$ material is positioned adjacent to the lateral edges 34, such that the higher $D_k$ material substantially (either completely or at least mostly) surrounds the lower $D_k$ material.

The selected RF dielectric material(s) of the layers 25 can also be chosen from composite polymer resin systems designated as high frequency dielectric material. In terms of high frequency, this refers to an operational RF frequency "$f_r$" range of the antenna 10 selected in the overall radio frequency RF band of, for example, from about 300 MHz to about 5 GHz, or preferably from about 400 MHz to about 4 GHz, or more preferably from about 500 MHz to about 3 GHz, or still more preferably from about 600 MHz to about 3 GHz, or still more preferably from about 700 MHz to about 2.4 GHz. Specific example operational $f_r$ ranges in the RF frequency band for the layers 25 of the layered dielectric structure 24 can be chosen from the above radio frequency RF band ranges.

In terms of composite polymer resin systems, for use as one or more of the layers 25 in the layered dielectric structure 24, these are typically designated as high frequency RF dielectric materials. Examples of this RF dielectric material type can include both unfilled and filled polymer resin systems and there are several different types of high frequency dielectric materials to consider as RF dielectric material for use in one or more of the layers 25 of the antenna 10. Composite polymer resin systems consist of a resin carrier and can have a filler inserted into the resin carrier used for mechanical integrity of the composite dielectric material, while some high frequency dielectric material options are made up of unfilled resin carriers only. It is recognized that "filled" refers to a dispersion of particulate matter (e.g. ceramic particles, glass particles, non-organic particles, etc.) throughout the polymer based resin of the high frequency laminate. For example, the filled composite polymer resin system can contain, by example only, anywhere between 45 to 55 volume % of particulate fill material (e.g. ceramic, silane coated ceramic, fused amorphous silica, etc.). Particulate dimensions of the fill material can be on the order of micro meters (e.g. the range of 5 to 50 micro meters). It is also recognized that the resin carrier of the composite polymer resin system can be referred to as a thermoset polymer or a thermoplastic polymer (e.g. addition polymers such as vinyl chain-growth polymers-polyethylene and/or polypropylene).

Example composite polymer resin systems using thermoplastic polymer based carriers can be PTFE filled or unfilled such as but not limited to: low filled random glass PTFE as an example of a filled polymer resin system; woven glass PTFE as an example of an unfilled polymer resin system; ceramic filled PTFE as an example of a filled polymer resin system; and woven glass/ceramic filled PTFE as an example of a filled polymer resin system. It is also recognized that generic ceramic filled polymer is an example of a filled polymer resin system and Liquid Crystalline Polymer (LCP) is an example of an unfilled polymer resin system.

Preferred examples of a thermoplastic carrier filled dielectric material include ceramic filled PTFE dielectric materials, which offer some advantages to the antenna fabricator and the end user, and low filled random glass PTFE materials. Specific examples of the preferred ceramic filled PTFE dielectric materials include AD1000 and AD600, with a nominal dielectric constant $D_k$ of 10.9 and 6.0 respectively, which are ceramic powder filled, woven glass reinforced laminates classified as a PTFE and Microdispersed Ceramic laminates reinforced with Commercial Grade Glass (inorganic/ceramic fillers). AD1000 and AD600 are considered "soft" dielectric materials allowing production without using the complicated processing or fragile handling associated with brittle ceramic materials or ceramic polymer materials. AD1000 and AD600 are manufactured by Arlon Materials for Electronics (MED), a Division of WHX Corporation.

Other preferred examples of a thermoplastic carrier filled dielectric material include materials manufactured by Arlon Materials for Electronics as PTFE-Microdispersed Ceramic laminates reinforced with Commercial Grade Glass, namely AD350A ($D_k$=3.50), AD410 ($D_k$=4.10), AD430 ($D_k$=4.30), and AD450 ($D_k$=4.50), for example. Arlon Materials for Electronics (MED) RF grade dielectric materials have dissipation factors $D_f$ in the range of 0.009 to 0.0038.

A further preferred example of ceramic filled PTFE dielectric material for the layers 25 is Taconic™ RF laminates such as CER-10 RF & Microwave Laminate. The CER-10 dielectric material has a dielectric constant $D_k$ of 10 at 10 GHz based on a test method of IPC TM 650 2.5.5.6. CER-10 also has a dissipation factor $D_f$ of 0.0035 using test method at 10 GHz of IPC-TM-650 2.5.5.5.1.

Further to the above, a specific example of a thermoset carrier filled dielectric material suitable for the layers 25 is Rogers RO4000™ high frequency circuit materials, which are glass-reinforced polymer/ceramic laminates, not Teflon™. The thermoset carrier filled dielectric material combines high frequency performance comparable to woven glass PTFE dielectric materials with the ease—and hence low cost—of fabrication associated with epoxy/glass laminates. The RO4000™ dielectric material is a woven glass reinforced, ceramic filled thermoset material with a very high glass transition temperature (Tg>280° C.), having a $D_k$=3.38 or 3.48 depending upon formulation. In terms of dissipation factor $D_f$, this value rages between 0.0021 to 0.0037 depending upon formulation and test conditions (e.g. for 23 Celcius and 2.5/10 GHz using test method IPC-TM-650 2.5.5.5). Other available dielectric materials include RO4360™ high frequency material offering a $D_k$ of 6.15. The RO4360™ and RO4000™ dielectric materials are manufactured by Rogers™ Corporation.

It is understood that the above defined $D_k$ and/or $D_f$ values can be used to define any selected RF dielectric material of the layers 25 suitable for use in manufacture and operation of the antenna 10 for RF applications, and to therefore include any number of different dielectric material types having the same specified $D_k$ and/or $D_f$ values. Alternatively, it is recognised that the dielectric material type (e.g. composite polymer resin systems such as ceramic filled, non filled, etc.) can also be used to define any selected RF dielectric material of the layers 25 suitable for use in manufacture and operation of the antenna 10 for RF applications. Alternatively, it is recognised that the dielectric material type in combination with any of the above defined $D_k$ values intrinsic to the material type can be used to define any selected RF dielectric material of the layers 25 suitable for use in manufacture and operation of the antenna 10 for RF applications.

Figure 19A:
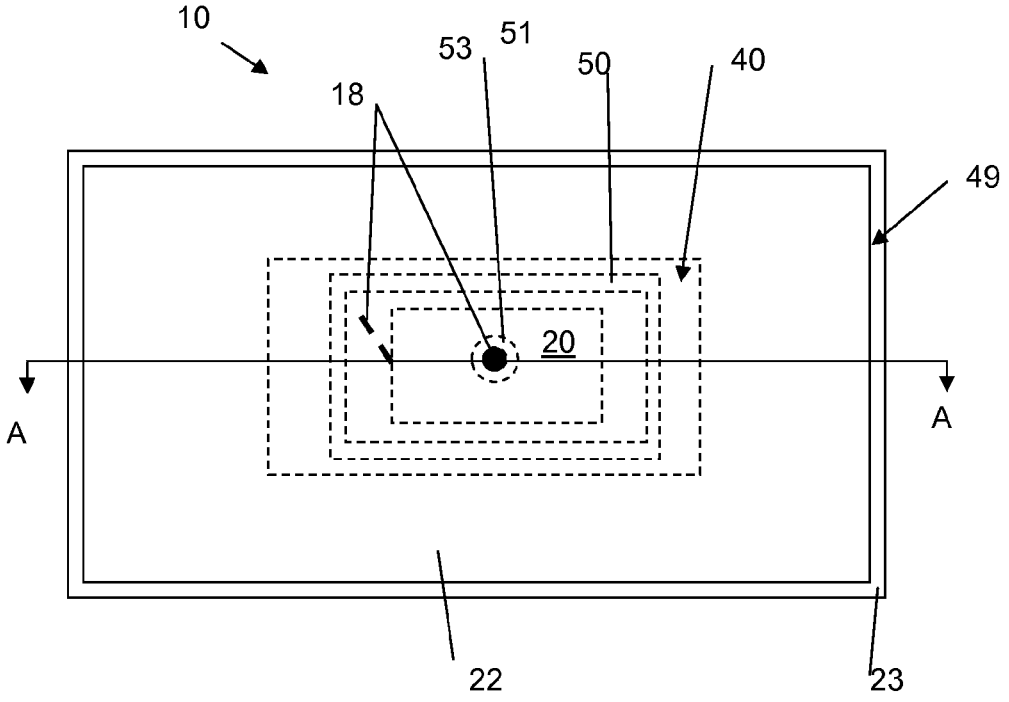
FIG. 19*a* is a top view of an alternative embodiment of the antenna of FIG. 1 including a radio device positioned inside of the antenna.
Figure 19B:
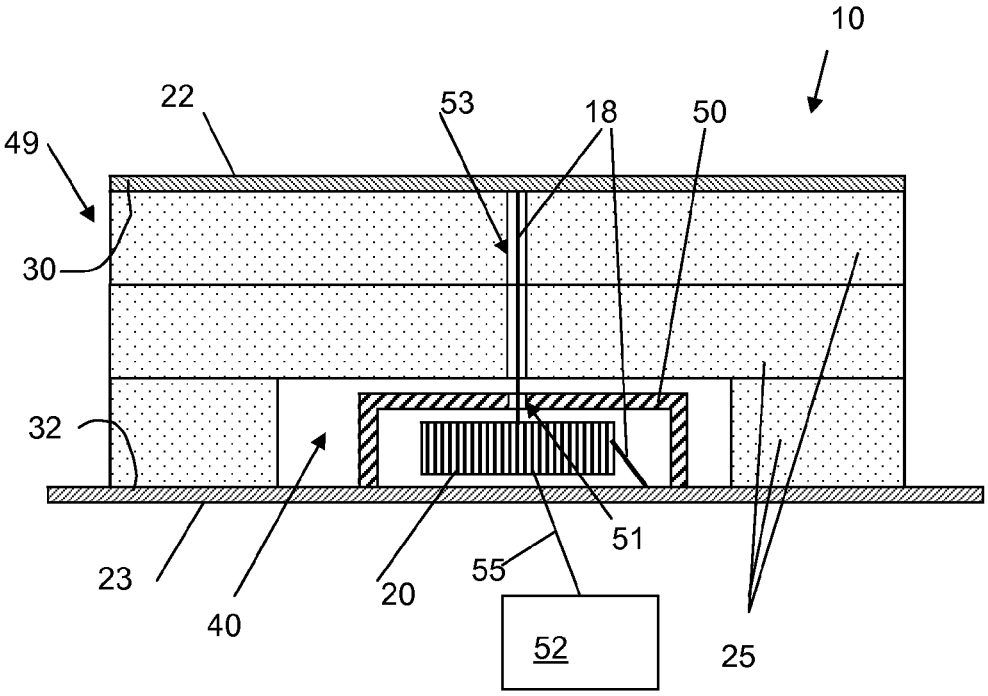
FIG. 19*b* is a cross section A-A view of the antenna of FIG. 19*a;*

Referring to FIGS. 19*a* and 19*b*, an alternative embodiment of the antenna 10 is shown where the radio device 20 is positioned within a cavity 40. The radio device 20 is connected from inside of the cavity 40 to the active element 22 and ground element 23 of the antenna 10 by the feed lines 18. The feed line 18 between the radio device 20 and the active element 22 is attached by passing through a hole 51 in an Electromagnetic Interference (EMI) shield 50 and a corresponding passage 53 in the layer(s) 25 of the dielectric element 49. One example of the dielectric element 49 can be embodied as the dielectric structure 24 (see FIG. 2) as described above having RF dielectric material in multiple layers 25. Alternatively, the dielectric element 49 can consist of one layer 25 of the RF dielectric material. Further, the radio device 20 also can be coupled to a power source 52, such as a battery, by power coupling 55 for use in driving generation of the electromagnetic radiation 12 by the active element 22.

Accordingly, as shown in FIGS. 19*a* and 19*b*, the radio device 20 is embedded or otherwise positioned in the antenna 10 by being situated within the cavity 40, which can be positioned in the dielectric structure 24 between the first surface 30 and the second surface 32. One advantage of having the radio device 20 embedded in the antenna 10 is that the length of the feed lines 18 can be reduced, as compared to a similar radio device positioned outside (not shown) of the antenna 10. Another advantage of having the radio device 20 embedded in the antenna 10 is that the total amount of space used by both the antenna 10 and embedded radio device 20 within a housing of a portable device (not shown) is reduced, as compared to the configuration of a similar radio device positioned outside (not shown) of the antenna 10.

Referring again to FIGS. 19*a* and 19*b*, the EMI shield 50 is positioned within the cavity 40 and between the radio device 20 and the dielectric element 49, since reception or transmission of the desired signal (i.e. electromagnetic radiation 12) by the active element 22 can be affected by EMI generated through operation of the radio device 20. For example, every time a digital circuit of the radio device 20 switches state, the resultant emanating electromagnetic waves could be considered as EMI by the active element 22. It is also recognised that operation of the radio 20 can be affected by the electromagnetic radiation 12 (received or transmitted by the active element 22) acting as EMI, for any portion of the electromagnetic radiation 12 directed towards the radio device 20. Accordingly, the shape and/or material of the EMI shield 50 can be configured to inhibit or otherwise deflect the transmission of any EMI generated by the operation of the radio 20 away from the active element 22, and can be configured to inhibit or otherwise deflect the transmission of any EMI generated by operation of the active element 22 away from the radio device 20. In FIG. 19, the EMI shield 50 is directly electrically coupled to the ground element 23, which cooperates structurally with the EMI shield 50 to enclose the radio device 20.

Figure 20:
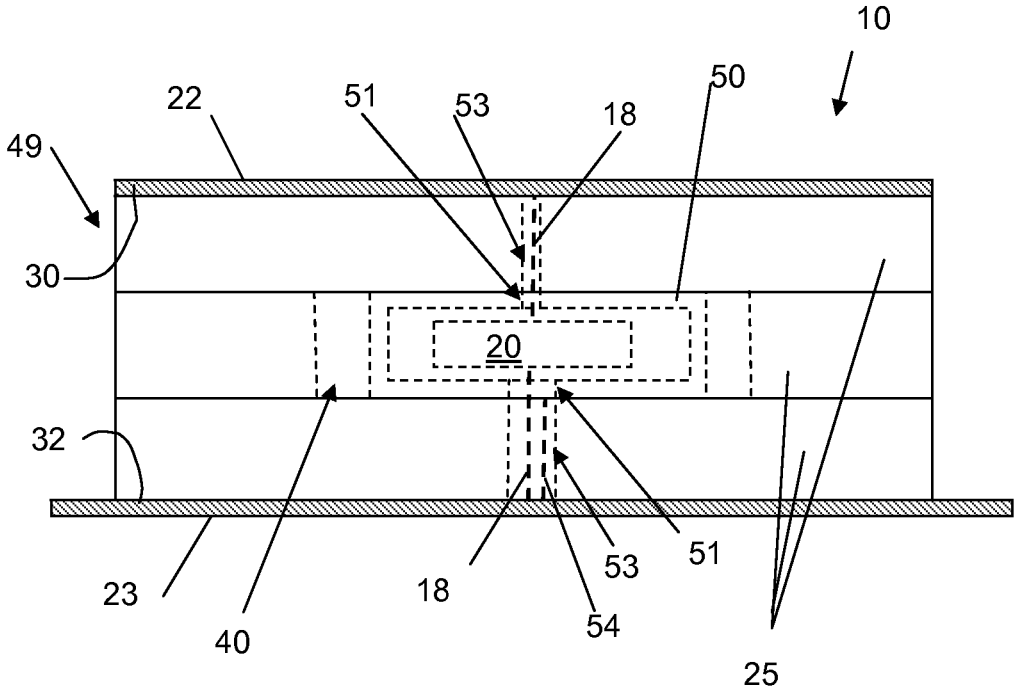
FIG. 20 is a side view of a further alternative embodiment of the antenna of FIG. 1 including a radio device positioned inside of the antenna.

An alternative configuration of the EMI shield 50 is shown in FIG. 20, wherein the EMI shield 50 itself encloses the radio device 20. In turn, the EMI shield 50 is indirectly connected to the ground element 23 by one or more ground lines 54 via the passage 53. The ground line(s) 54 can be any suitable means for grounding the EMI shield 50 to the ground of the antenna 10 (e.g. the ground element 23 and/or the ground structure 26—see FIG. 3) including by example, without limitation, a coaxial or other shielded cable, insulated and spaced conductors or any other suitable means for conveying EMI generated currents between the EMI shield 50 and the ground of the antenna 10.

The feed line 18 is attached between the radio device 20 and the ground element 23 by passing through the corresponding hole 51 in the EMI shield 50 and the associated passage 53 in the layer(s) 25 of the dielectric element 49. It is recognised that the feed line 18 between the radio device 20 and the ground element 23 and the ground line(s) 54 between the EMI shield 50 and the ground element 23 can be combined, as desired.

The EMI shield 50 acting a Radio Frequency (RF) shield is composed of an electrically conductive material. For example, the EMI shield 50 can be composed of copper. Preferably, the EMI shield 50 can be composed of ferromagnetic material such as but not limited to steel or solderable steel (e.g. tin coated steel). Another alternative is for the EMI shield 50 can be a combination of both with a layer of copper and a layer of steel or tin-coated steel.

In general, RF shields attenuate the EMI by providing an alternative, lower impedance path for the EMI, as well as providing for deflection of the EMI away from it's directed target. The material of the EMI shield 50 can be any electrically conductive material such as but not limited to copper or any ferromagnetic material. It is recognised that because of the presence of the EMI shield 50 when in the cavity 40, it is preferred that the cavity 40 is positioned in the dielectric structure 24 adjacent to the ground element 23, since in general as the active element 22 is moved closer to the ground element 23, thereby decreasing thickness T, less energy is radiated and more energy is stored in the capacitance and inductance of the antenna 10, that is, the quality factor Q of the antenna 10 increases. It is recognised that the EMI shield 50 is connected to the ground element 23, or ground structure 26, and as such is preferably positioned as far as possible away from the active element 22 in order to minimize the quality factor Q of the antenna 10.

Figure 21:
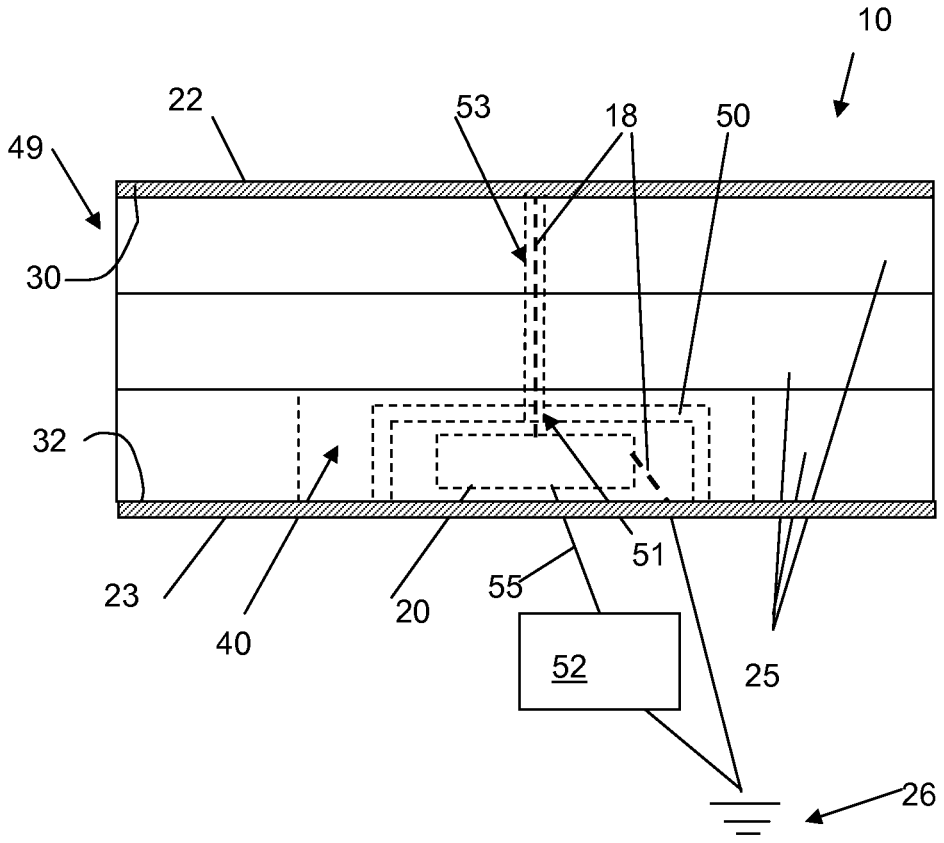
FIG. 21 is a side view of a further alternative embodiment of the antenna of FIG. 1 including a radio device positioned inside of the antenna.
Figure 22:
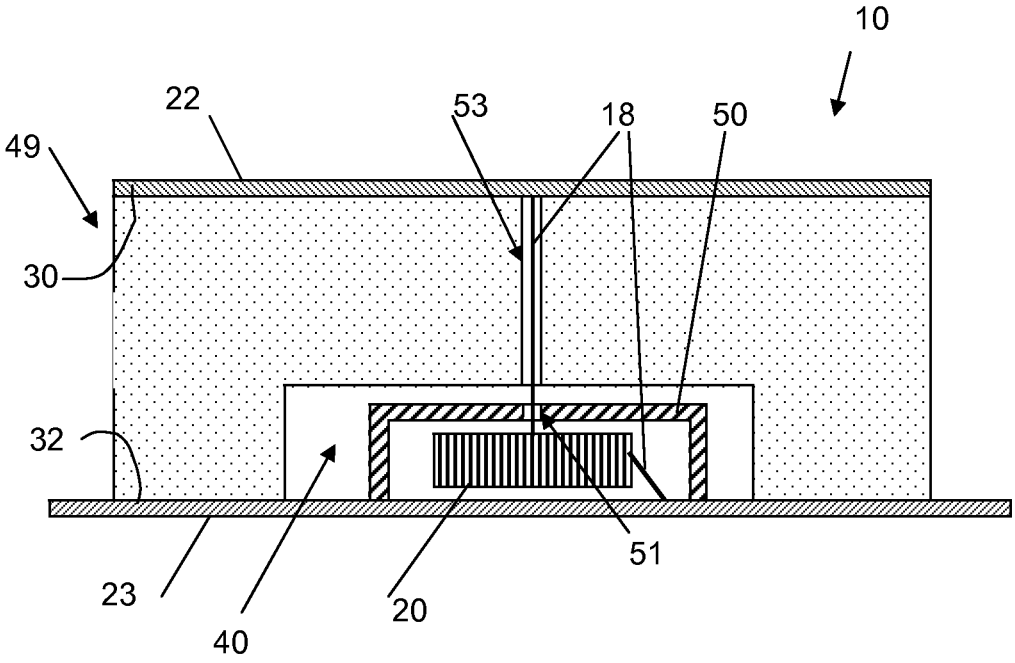
FIG. 22 is a side view of a further alternative embodiment of the antenna of FIG. 1 including a radio device positioned inside of the antenna.

Alternatively in absence of the ground element 23, as shown in FIG. 21, the radio device 20 is connected from inside of the cavity 40 to the active element 22 and the ground structure 26 of the antenna 10 by the feed line 18. This embodiment shows, by example only, the EMI shield 50 is connected to the ground structure 26 by the feed line 18.

In view of the above discussion on the configuration of layers 25 in the dielectric structure 24, it is recognised that the dielectric element 49 can have only one layer of RF dielectric material or can have a number of layers 25 embodied as the dielectric structure 25, as desired.

Figure 23:
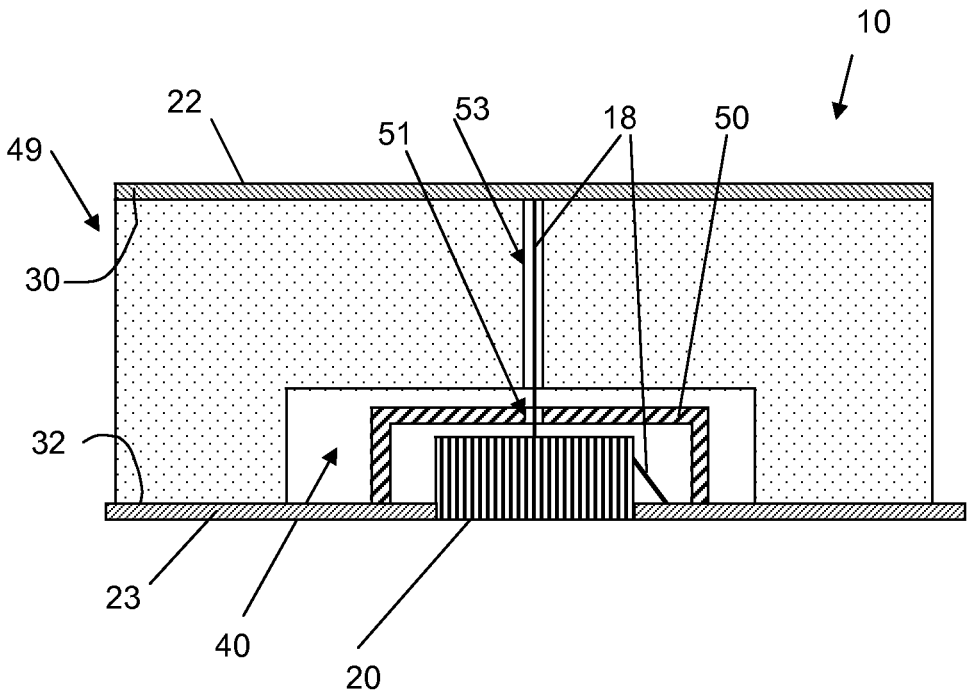
FIG. 23 is a side view of a further alternative embodiment of the antenna of FIG. 1 including a radio device positioned inside of the antenna.

A further embodiment of the antenna 10 with embedded radio device 20 is shown in FIG. 23. In this example, the radio device 20 is only partially contained within the cavity 40, and as such at least a portion of the radio device 20 projects outwards from the second external surface 32 of the dielectric element 49. As shown is only one layer, however it is recognised that the dielectric element 49 can have more than one layer 25 of RF dielectric material, as desired.

Further in view of the above, it is recognised that the radio device 20 and associated EMI shield 50 can be inserted into a mould (not shown) for forming the dielectric element 49 (e.g. a sintering mould), Accordingly, the dielectric element 49 could be formed about the exterior of the EMI shield 50, such that the cavity 40 is created during the formation process of the dielectric element 49 by the presence of the radio device 20 and associated EMI shield 50 in the mould. In this manner, it is recognised that at least a portion of the walls 42 cavity 40 could conform to at least a portion of the exterior of the EMI shield 50. It is also envisioned that a protective envelope or covering could be positioned about the exterior surface of the EMI shield 50 before placing the EMI shield 50 in the mould.

In view of the above, it is recognised that antennas 10 can be used in systems such as radio and television broadcasting, point-to-point radio communication, wireless LAN, radar, product tracking and/or monitoring via Radio-frequency identification (RFID) applications. Radio frequency (RF) electromagnetic radiation 12 has an example frequency of 300 Hz to 14 GHz. This range of RF electromagnetic radiation 12 constitutes the radio spectrum and corresponds to the frequency of alternating current electrical signals 16 used to produce and detect RF electromagnetic radiation 12 in the environment 14. Ultra high frequency (UHF) designates a range of RF electromagnetic radiation 12 with frequencies between 300 MHz and 3 GHz. For example, RF can refer to electromagnetic oscillations in either electrical circuits or radiation through air and space. For example, antennas 10 can be usually employed at UHF and higher frequencies since the size of the antenna can influence the wavelength at the resonance frequency of the antenna 10.

Further, it is recognised that the dielectric structure 24 is advantageous as a resonant structure with selected RF dielectric properties, as the material discontinuity of the layers 25 provides for a higher overall dielectric constant for the stack layer arrangement as compared to a single block type of dielectric structure 24 of similar thickness T. Using a single thickness dielectric structure 24 for increasingly larger thickness T can result in substantive decreases in the dielectric constant exhibited by the RF dielectric material. Accordingly, the use of multiple layers 25 to make the dielectric structure 24 helps to inhibit substantive decreases in the effective dielectric constant for the dielectric structure 24. Further, it is recognised that antenna 10 shapes can be such as but not limited to; square, rectangular, circular and elliptical, as well as any continuous shape.

As shown in FIG. 2, the feed line 18 in a radio transmission, reception or transceiver system is the physical cabling that carries the RF signal to and/or from the antenna 10. The feed line 18 carries the RF energy for transmission and/or as received with respect to the antenna 10. As well, the antenna 10 has an active element 22 adhered to the dielectric structure 24 providing a dielectric resonator property, comprised of the plurality of dielectric layers 25 and interposed gap layers 28. A dielectric resonator property can be defined as an electronic component that exhibits resonance for a selected narrow range of RF frequencies, generally in the microwave band. The resonance of the dielectric structure 24 can be similar to that of a circular hollow metallic waveguide, except that the boundary is defined by large change in permittivity rather than by a conductor. Dielectric resonator property of the dielectric structure 24 is provided by the specified thickness T of RF dielectric material, in this case as a plurality of separated layers 25 (e.g. ceramic) such that each of the layers 25 have a respectively larger dielectric constant and a lower dissipation factor. The resonance frequency of the dielectric structure 24 can be determined by the overall physical dimensions of the dielectric structure 24 and the dielectric constant of the RF dielectric material(s) used in the layers 25. It is recognised that dielectric resonators can be used to provide a frequency reference in an oscillator circuit, such that an unshielded RF dielectric resonator is used in the antenna 10 to facilitate interaction with RF electromagnetic radiation 12.

I claim:

1. A dielectric structure positioned adjacent to an active element of an antenna for a radio frequency (RF) application, the dielectric structure comprising:

a plurality of individual layers in a stacked layer arrangement including a first layer having a top surface and an opposing bottom surface and including a first RF dielectric material, a second layer adjacent to and in contact with the first layer, the second layer having a top surface and an opposing bottom surface and including a second RF dielectric material, a third layer adjacent to and spaced apart from the second layer by a predetermined distance to form a gap layer between the second layer and the third layer;

a passage in the third layer configured to route a grounding line to a ground element of the antenna, the ground element disposed below the third layer; and at least one non-conductive mechanical fastening mechanism configured to couple the plurality of individual layers to one another and to inhibit short-circuiting the active element with the ground element of the antenna.

2. The dielectric structure of claim 1, wherein the first RF dielectric material and the second RF dielectric material have substantially similar dielectric constants $D_k$.

3. The dielectric structure of claim 1, wherein a resonance frequency of the RF application is between about 300 MHz and about 14 GHz.

4. The dielectric structure of claim 1 wherein the predetermined distance is substantially less than a layer thickness of each of the plurality of individual layers.

5. The dielectric structure of claim 4 further comprising a gap material positioned in the gap layer, the gap material being RF unsuitable material for resonating at a resonance frequency of the RF application.

6. The dielectric structure of claim 5, wherein the gap material is an adhesive for adhering the third layer to the second layer.

7. The dielectric structure of claim 5, wherein the gap material has a dielectric constant value from about $D_k$=1.0 to about $D_k$=4.0.

8. The dielectric structure of claim 4 wherein the plurality of individual layers in the stacked layer arrangement further include a fourth layer adjacent to the third layer, the fourth layer including a fourth RF dielectric material.

9. The dielectric structure of claim 8 wherein the fourth layer is spaced apart from the third layer to form a second gap layer between the third layer and the fourth layer.

10. The dielectric structure of claim 9 further comprising a second gap material positioned in the second gap layer, the second gap material being RF unsuitable material for resonating at a resonance frequency of the RF application.

11. The dielectric structure of claim 10, wherein the second gap material is an adhesive that adheres the third layer to the fourth layer.

12. The dielectric structure of claim 1, wherein at least one of the plurality of individual layers is composed of a composite polymer resin system having a resin carrier.

13. The dielectric structure of claim 12, wherein the resin carrier is polytetrafluoroethylene (PTFE).

14. The dielectric structure of claim 13, wherein the composite polymer resin system includes a filler inserted into the resin carrier.

15. The dielectric structure of claim 14, wherein filler is ceramic particles.

16. The dielectric structure of claim 1, wherein the first RF dielectric material has a dielectric constant value between $D_k$=2.0 and $D_k$=100.0 and the second RF dielectric material has a dielectric constant value between $D_k$=2.0 and $D_k$=100.0.

17. The dielectric structure of claim 4 further comprising a cavity positioned in the second layer.

18. The dielectric structure of claim 17, wherein the cavity is positioned in the second layer and the first layer is adapted for positioning adjacent to the active element.

19. The dielectric structure of claim 17 further comprising at least one additional layer positioned between the second layer and the third layer, wherein each additional layer includes an additional RF dielectric material.

20. The dielectric structure of claim 17 wherein the second layer includes a plurality of pieces, each piece being made of the second RF dielectric material, and wherein the plurality of pieces are arranged in the second layer to form the cavity.

21. The dielectric structure of claim 17, wherein walls of the cavity are positioned away from exterior lateral surfaces of the first, second, and third layers.

22. The dielectric structure of claim 19, wherein the cavity is positioned in a center of the second layer.

23. The dielectric structure of claim 2, wherein the first dielectric material and the second dielectric material are the same material type.

24. A dielectric structure positioned adjacent to an active element of an antenna for a radio frequency (RF) application, the dielectric structure comprising:

a plurality of individual layers in a stacked layer arrangement including a first layer having a top surface and an opposing bottom surface and including a first RF dielectric material, a second layer adjacent to and in contact with the first layer, the second layer having a top surface and an opposing bottom surface and including a second RF dielectric material, a third layer adjacent to and spaced apart from the second layer by a predetermined distance to form a gap layer between the second layer and the third layer; and a passage in the third layer configured to route a grounding line to a ground element of the antenna, the ground element disposed below the third layer, wherein, the predetermined distance is substantially less than a layer thickness of each of the plurality of individual layers, the plurality of individual layers in the stacked layer arrangement further include a fourth layer adjacent to the third layer, the fourth layer including a fourth RF dielectric material, and the fourth layer is spaced apart from the third layer to form a second gap layer between the third layer and the fourth layer.

25. A dielectric structure positioned adjacent to an active element of an antenna for a radio frequency (RF) application, the dielectric structure comprising:

a plurality of individual layers in a stacked layer arrangement including a first layer having a top surface and an opposing bottom surface and including a first RF dielectric material, a second layer adjacent to and in contact with the first layer, the second layer having a top surface and an opposing bottom surface and including a second RF dielectric material, a third layer adjacent to and spaced apart from the second layer by a predetermined distance to form a gap layer between the second layer and the third layer;

a passage in the third layer configured to route a grounding line to a ground element of the antenna, the ground element disposed below the third layer;

a cavity positioned in a center of the second layer; and at least one additional layer positioned between the second layer and the third layer, wherein the at least one additional layer includes an additional RF dielectric material.

* * * * *